US010061217B2

(12) United States Patent
Watanabe et al.

(10) Patent No.: US 10,061,217 B2
(45) Date of Patent: Aug. 28, 2018

(54) ELECTROPHOTOGRAPHY TONER

(71) Applicant: Kao Corporation, Tokyo (JP)

(72) Inventors: Shogo Watanabe, Izumiotsu (JP); Kohei Katayama, Wakayama (JP); Yasuhiro Hidaka, Kainan (JP); Hiroki Kakiuchi, Izumiotsu (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 15/532,372

(22) PCT Filed: Nov. 25, 2015

(86) PCT No.: PCT/JP2015/082990

§ 371 (c)(1),
(2) Date: Jun. 1, 2017

(87) PCT Pub. No.: WO2016/098537

PCT Pub. Date: Jun. 23, 2016

(65) Prior Publication Data

US 2017/0363981 A1 Dec. 21, 2017

(30) Foreign Application Priority Data

Dec. 16, 2014 (JP) ..... 2014-254151

(51) Int. Cl.
*G03G 9/08* (2006.01)
*G03G 9/087* (2006.01)

(52) U.S. Cl.
CPC ..... *G03G 9/08755* (2013.01); *G03G 9/08706* (2013.01); *G03G 9/08708* (2013.01); *G03G 9/08711* (2013.01)

(58) Field of Classification Search
CPC ..... G03G 9/08755; G03G 9/08706; G03G 9/08708; G03G 9/08711
USPC ..... 430/109.3, 109.4
See application file for complete search history.

(56) References Cited

U.S. PATENT DOCUMENTS 6,235,441 B1 5/2001 Tanikawa et al.
2007/0141498 A1* 6/2007 Umehara ..... G03G 9/081 430/108.21
2011/0217646 A1 9/2011 Shirai et al.
2011/0294061 A1 12/2011 Shirai et al.
2014/0363765 A1* 12/2014 Fukuri ..... G03G 9/081 430/137.15

FOREIGN PATENT DOCUMENTS

| | | | |
|---|---|---|---|
| JP | 2000-235279 | A | 8/2000 |
| JP | 2003-005431 | A | 1/2003 |
| JP | 2003-262978 | A | 9/2003 |
| JP | 2010-139659 | A | 6/2010 |
| JP | 2013-109237 | A | 6/2013 |
| JP | 2014-235409 | A | 12/2014 |
| JP | 2016-114828 | A | 6/2016 |
| JP | 2016-114829 | A | 6/2016 |

OTHER PUBLICATIONS

Supplementary Search Report dated May 28, 2018 issued in corresponding European patent application No. 15869745.8.

* cited by examiner

*Primary Examiner* — Mark A Chapman
(74) *Attorney, Agent, or Firm* — Oblon, McClelland, Maier & Neustadt, L.L.P.

(57) ABSTRACT

A toner for electrophotography containing a resin binder containing a crystalline resin and an amorphous resin, and a releasing agent, wherein the crystalline resin contains a crystalline composite resin C containing a polycondensation resin component and a styrenic resin component, wherein the polycondensation resin component is obtained by polycondensing a specified alcohol component and a specified carboxylic acid component, and wherein the amorphous resin contains an amorphous composite resin AC containing a polycondensation resin component and a styrenic resin component, wherein the polycondensation resin component is obtained by polycondensing an alcohol component and a specified carboxylic acid component, and an amorphous polyester AP obtained by polycondensing an alcohol component and a specified carboxylic acid component, wherein a softening point of the amorphous polyester AP is higher than a softening point of the amorphous composite resin AC, wherein a difference in softening points between the amorphous polyester AP and the amorphous composite resin AC is 10° C. or more and 50° C. or less. The toner for electrophotography of the present invention is suitably used in development of latent images or the like which is formed in, for example, electrostatic development method, electrostatic recording method, electrostatic printing method or the like.

20 Claims, No Drawings

ELECTROPHOTOGRAPHY TONER

FIELD OF THE INVENTION

The present invention relates to a toner for electrophotography usable in developing latent images formed in, for example, electrophotography, electrostatic recording method, electrostatic printing method or the like.

BACKGROUND OF THE INVENTION

From the viewpoint of speed-up of printing apparatuses and conservation of energy, a toner having excellent low-temperature fusing ability is in demand.

For example, Patent Publication 1 discloses a crystalline resin for a toner comprising a composite resin containing a polycondensation resin component and a styrenic resin component, wherein the polycondensation resin component is obtained by polycondensing an alcohol component containing an aliphatic diol having from 2 to 10 carbon atoms and a carboxylic acid component containing an aromatic dicarboxylic acid.

Patent Publication 2 discloses a toner for electrostatic image development comprising a resin binder comprising:

a crystalline hybrid resin (1-2) containing a crystalline polyester component and an addition polymerization resin component, obtained by polymerizing raw material monomers for a crystalline polyester containing a diol having from 8 to 12 carbon atoms and a dicarboxylic acid compound having from 10 to 12 carbon atoms, a total content of both the diol and the dicarboxylic acid compound is 80% by mol or more, raw material monomers for an addition polymerization resin, and a compound capable of reacting with both the raw material monomers for a crystalline polyester and the raw material monomers for an addition polymerization resin in an amount of from 3 to 15 parts by weight, based on 100 parts by weight of the raw material monomers for the addition polymerization resin; and an amorphous hybrid resin (2-2) containing an amorphous polycondensation resin component and an addition polymerization resin component, obtained by polymerizing raw material monomers for an amorphous polycondensation resin containing an alcohol component and a carboxylic acid component containing an aromatic dicarboxylic acid compound, raw material monomers for an addition polymerization resin, a compound capable of reacting with both the raw material monomers for an amorphous polycondensation resin and the raw material monomers for an addition polymerization resin in an amount of from 2 to 15 parts by weight, based on 100 parts by weight of the raw material monomers for an addition polymerization resin, wherein a weight ratio of the crystalline hybrid resin (1-2) to the amorphous hybrid resin (2-2) (crystalline hybrid resin (1-2)/amorphous hybrid (2-2)) is from 1/99 to 40/60.

Patent Publication 1: Japanese Patent Laid-Open No. 2010-139659

Patent Publication 2: Japanese Patent Laid-Open No. 2013-109237

SUMMARY OF THE INVENTION

The present invention relates to a toner for electrophotography containing a resin binder containing a crystalline resin and an amorphous resin, and a releasing agent, wherein the crystalline resin contains a crystalline composite resin C containing a polycondensation resin component and a styrenic resin component, wherein the polycondensation resin component is obtained by polycondensing an alcohol component containing an aliphatic diol having 9 or more carbon atoms and 14 or less carbon atoms, and a carboxylic acid component containing an aliphatic dicarboxylic acid compound having 9 or more carbon atoms and 14 or less carbon atoms, and wherein the amorphous resin contains an amorphous composite resin AC containing a polycondensation resin component and a styrenic resin component, wherein the polycondensation resin component is obtained by polycondensing an alcohol component and a carboxylic acid component containing an aromatic dicarboxylic acid compound, and an amorphous polyester AP obtained by polycondensing an alcohol component and a carboxylic acid component containing an aromatic dicarboxylic acid compound, wherein a softening point of the amorphous polyester AP is higher than a softening point of the amorphous composite resin AC, wherein a difference in softening points between the amorphous polyester AP and the amorphous composite resin AC is 10° C. or more and 50° C. or less.

DETAILED DESCRIPTION OF THE INVENTION

In the crystalline resin described in Patent Publication 1, an aromatic dicarboxylic acid compound is used as the carboxylic acid component constituting the polycondensation resin component, and a medium-chained aliphatic diol is used as the alcohol component, so that the compatibility with the amorphous resin becomes higher, thereby lowering crystallinity of the crystalline resin, whereby it is not yet said to have sufficient low-temperature fusing ability.

In addition, in the crystalline resin described in Patent Publication 2, even though sebacic acid is used as the carboxylic acid component constituting the polycondensation resin component, and a long-chained aliphatic diol is used as the alcohol component, a hybrid resin is used as an amorphous resin, so that releasing property is lowered, whereby it is not yet said to be sufficient in wrapping-jam of sheets during fusing.

The present invention relates to a toner for electrophotography having excellent low-temperature fusing ability, durability, and control in wrapping-jam of sheets during fusing.

The toner for electrophotography of the present invention exhibits some excellent effects in low-temperature fusing ability, durability, and control in wrapping-jam of sheets during fusing.

The toner for electrophotography (hereinafter also simply referred to as toner) of the present invention contains a resin binder containing a crystalline resin and an amorphous resin, and a releasing agent, wherein the crystalline resin contains a crystalline composite resin C containing a polycondensation resin component using a long-chained aliphatic monomer, and wherein the amorphous resin contains an amorphous composite resin AC containing a polycondensation resin component using an aromatic dicarboxylic acid compound, and an amorphous polyester AP using an aromatic dicarboxylic acid compound having a softening point higher than the amorphous composite resin AC.

Although the reasons why the toner for electrophotography of the present invention has excellent low-temperature fusing ability, durability, and control in wrapping-jam of sheets during fusing are not certain, it is considered to be as follows.

Since the crystalline composite resin C contains a polycondensation resin component using a long-chained aliphatic monomer, its hydrophobicity is high. Therefore, when the crystalline composite resin C is used together with the amorphous polyester, since its compatibility with the amorphous polyester is low, the crystalline composite resin is more likely to be crystallized, so that dispersibility in the amorphous polyester is worsened, whereby the effects of improving low-temperature fusing ability by the crystalline resin are not exhibited. Further, the crystalline composite resin C and the amorphous polyester are likely to crack at the interface thereof, thereby also lowering durability.

When an amorphous composite resin is also used as an amorphous resin, it has been found that even though low-temperature fusing ability and durability are improved, the wrapping-jam of sheets on the roller during fusing is generated. This is assumed to be due to the fact that the composite resin has a high hydrophobicity, so that dispersibility of a releasing agent becomes exceedingly well, whereby the content of the releasing agent in toner fine powders generated during a pulverizing step or in toner fine powders generated during continuous printing in the process of producing a toner is reduced. In a usual toner, dispersibility of a releasing agent is low, and a toner is pulverized at an interface of the releasing agent, so that it is considered that pulverized toner fine powders contain a large amount of the releasing agent, whereby making it less likely to cause wrapping-jam of sheets.

In view of the above, the present inventors have found that by the use of each of an amorphous polyester AP obtained by polycondensing an alcohol component and a carboxylic acid component containing an aromatic dicarboxylic acid compound as a high-softening point resin, and an amorphous composite resin AC containing a polycondensation resin component and a styrenic resin component, wherein the polycondensation resin component is obtained by polycondensing an alcohol component and a carboxylic acid component containing an aromatic dicarboxylic acid compound as a low-softening point resin, the wrapping-jam of sheets during fusing can be controlled, in addition to low-temperature fusing ability and durability, even when the crystalline composite resin C containing a polycondensation resin component using a long-chained aliphatic monomer is used as a crystalline resin. This is considered to be due to the fact that compatibility between the crystalline resin and the amorphous resin is maintained by the use of an amorphous composite resin AC and a crystalline composite resin C, and at the same time dispersibility of a releasing agent is optimized by further use of an amorphous polyester AP as a high-softening point resin, and the strength of the toner overall can be increased.

In the present invention, the crystallinity of the resin is expressed by a crystallinity index defined by a value of a ratio of a softening point to a highest temperature of endothermic peak determined by a scanning differential calorimeter, i.e. [softening point/highest temperature of endothermic peak]. The crystalline resin is a resin having a crystallinity index of from 0.6 to 1.4, preferably from 0.7 to 1.2, and more preferably from 0.9 to 1.2, and the amorphous resin is a resin having a crystallinity index exceeding 1.4 or less than 0.6, preferably exceeding 1.5 or 0.5 or less, and more preferably 1.6 or more or 0.5 or less. The crystallinity of the resin can be adjusted by the kinds of the raw material monomers and ratios thereof, production conditions (e.g., reaction temperature, reaction time, cooling rate), and the like. Here, the highest temperature of endothermic peak refers to a temperature of the peak on the highest temperature side among endothermic peaks observed. In the crystalline resin, the highest temperature of endothermic peak is defined as a melting point. Here, in the present invention, when simply referred to as the "resin," it means both the crystalline resin and the amorphous resin.

The crystalline composite resin C contained in the crystalline resin is a resin containing a polycondensation resin component and a styrenic resin component, wherein the polycondensation resin component is obtained by polycondensing an alcohol component containing an aliphatic diol having 9 or more carbon atoms and 14 or less carbon atoms and a carboxylic acid component containing an aliphatic dicarboxylic acid compound having 9 or more carbon atoms and 14 or less carbon atoms.

The polycondensation resin component includes polyesters, polyester-polyamides, and the like, and the polyesters are preferred, from the viewpoint of improving low-temperature fusing ability and durability of the toner.

It is preferable that the polyester is obtained by polycondensing an alcohol component containing a dihydric or higher polyhydric alcohol and a carboxylic acid component containing a dicarboxylic or higher polycarboxylic acid compound.

The number of carbon atoms of the aliphatic diol contained in the alcohol component for the polycondensation resin component is 9 or more, preferably 10 or more, and more preferably 12 or more, from the viewpoint of durability. In addition, the number of carbon atoms is 14 or less, and preferably 12 or less, from the same viewpoint.

The aliphatic diol having 9 or more carbon atoms and 14 or less carbon atoms includes 1,9-nonanediol, 1,10-decanediol, 1,12-dodecanediol, 1,14-tetradecanediol, and the like, and especially linear $\alpha,\omega$-alkanediols are preferred, one or two members selected from 1,10-decanediol and 1,12-dodecanediol are more preferred, and 1,12-dodecanediol is even more preferred, from the viewpoint of increasing crystallinity of the composite resin, thereby improving low-temperature fusing ability and durability of the toner.

The content of the aliphatic diol having 9 or more carbon atoms and 14 or less carbon atoms is preferably 70% by mol or more, more preferably 90% by mol or more, and even more preferably 95% by mol or more, and preferably 100% by mol or less, more preferably substantially 100% by mol, and even more preferably 100% by mol, in a total amount of the dihydric or higher polyhydric alcohol of the alcohol component, from the viewpoint of improving low-temperature fusing ability and durability of the toner. Further, the proportion of one kind out of the aliphatic diol having 9 or more carbon atoms and 14 or less carbon atoms occupying the dihydric or higher polyhydric alcohol of the alcohol component is preferably 50% by mol or more, more preferably 70% by mol or more, even more preferably 90% by mol or more, and even more preferably 95% by mol or more, and preferably 100% by mol or less, more preferably substantially 100% by mol, and even more preferably 100% by mol, from the same viewpoint.

The alcohol component may contain a polyhydric alcohol other than the aliphatic diol having 9 or more carbon atoms and 14 or less carbon atoms, which includes aromatic diols such as an alkylene oxide adduct of bisphenol A; and trihydric or higher polyhydric alcohols such as glycerol, pentaerythritol, trimethylolpropane, sorbitol, and 1,4-sorbitan.

The number of carbon atoms of the aliphatic dicarboxylic acid compound contained in the carboxylic acid component for the polycondensation resin is 9 or more, and preferably 10 or more, from the viewpoint of low-temperature fusing ability. Also, the number of carbon atoms is 14 or less, preferably 12 or less, more preferably 10 or less, and even more preferably 10, from the viewpoint of durability.

The aliphatic dicarboxylic acid compound having 9 or more carbon atoms and 14 or less carbon atoms is preferably linear α,ω-alkanedicarboxylic acid compounds, which include azelaic acid, sebacic acid, dodecanedioic acid, tetradecanedioic acid, and the like, from the viewpoint of increasing crystallinity of the composite resin, thereby increasing low-temperature fusing ability and durability, and the aliphatic dicarboxylic acid compound is preferably one or two members selected from sebacic acid and dodecanedioic acid, and more preferably sebacic acid, from the viewpoint of improving durability of the toner. Here, the dicarboxylic acid compound refers to dicarboxylic acids, anhydrides thereof, and alkyl esters thereof having 1 or more carbon atoms and 3 or less carbon atoms, among which the dicarboxylic acids are preferred. The number of carbon atoms of the aliphatic dicarboxylic acid compound refers to the number of carbon atoms including the dicarboxylic acid moiety, and not including the alkyl ester moiety.

The content of the aliphatic dicarboxylic acid compound having 9 or more carbon atoms and 14 or less carbon atoms is preferably 70% by mol or more, more preferably 90% by mol or more, and even more preferably 95% by mol or more, and preferably 100% by mol or less, more preferably substantially 100% by mol, and even more preferably 100% by mol, of a total amount of the dicarboxylic or higher polycarboxylic acid compound in the carboxylic acid component, from the viewpoint of increasing crystallinity of the composite resin, thereby increasing low-temperature fusing ability and durability.

The carboxylic acid component may contain a polycarboxylic acid compound other than the aliphatic dicarboxylic acid compound having 9 or more carbon atoms and 14 or less carbon atoms, and the polycarboxylic acid compound includes aliphatic dicarboxylic acids such as oxalic acid, malonic acid, maleic acid, fumaric acid, citraconic acid, itaconic acid, glutaconic acid, succinic acid, adipic acid, succinic acid substituted with an alkyl group having 1 or more carbon atoms and 30 or less carbon atoms or an alkenyl group having 2 or more carbon atoms and 30 or less carbon atoms; aromatic dicarboxylic acids such as phthalic acid, isophthalic acid, and terephthalic acid; alicyclic dicarboxylic acids such as cyclohexanedicarboxylic acid; aromatic tricarboxylic or higher polycarboxylic acids such as trimellitic acid, 2,5,7-naphthalenetricarboxylic acid, and pyromellitic acid; acid anhydrides thereof, and alkyl esters thereof having 1 or more carbon atoms and 3 or less carbon atoms.

In addition, it is preferable that the raw material monomers for the polycondensation resin component for the crystalline composite resin C contain at least one of an aliphatic monocarboxylic acid compound having 8 or more carbon atoms and 22 or less carbon atoms and an aliphatic monohydric alcohol having 8 or more carbon atoms and 22 or less carbon atoms, from the viewpoint of low-temperature fusing ability.

The number of carbon atoms of the aliphatic monohydric alcohol and the aliphatic monocarboxylic acid compound is preferably 8 or more, more preferably 12 or more, and even more preferably 14 or more, from the viewpoint of low-temperature fusing ability. In addition, the number of carbon atoms is preferably 22 or less, more preferably 20 or less, and even more preferably 18 or less, from the viewpoint of productivity.

The aliphatic monohydric alcohol having 8 or more carbon atoms and 22 or less carbon atoms includes aliphatic alcohols such as palmityl alcohol, stearyl alcohol, and behenyl alcohol, and the like, among which stearyl alcohol is preferred.

The aliphatic monocarboxylic acid compound having 8 or more carbon atoms and 22 or less carbon atoms includes aliphatic carboxylic acid compounds such as palmitic acid, stearic acid, and behenic acid, and the like, among which stearic acid is preferred.

A total content of the aliphatic monohydric alcohol having 8 or more carbon atoms and 22 or less carbon atoms and the aliphatic monocarboxylic acid compound having 8 or more carbon atoms and 22 or less carbon atoms in the raw material monomers for the polycondensation resin component for the crystalline composite resin C, in other words, a total amount of the alcohol component and the carboxylic acid component, is preferably 1% by mol or more, more preferably 2% by mol or more, and even more preferably 3% by mol or more, from the viewpoint of low-temperature fusing ability. In addition, the total content is preferably 12% by mol or less, more preferably 10% by mol or less, even more preferably 8% by mol or less, and even more preferably 6% by mol or less, from the viewpoint of durability.

It is assumed that the dually reactive monomer described later is not included in the calculations of the contents of the alcohol component and the carboxylic acid component. The same applies to the amorphous composite resin.

A total number of moles of the aliphatic dicarboxylic acid compound having 9 or more carbon atoms and 14 or less carbon atoms and the aliphatic diol having 9 or more carbon atoms and 14 or less carbon atoms is preferably 88% by mol or more, more preferably 90% by mol or more, even more preferably 92% by mol or more, and even more preferably 94% by mol or more, and preferably 100% by mol or less, more preferably 99% by mol or less, even more preferably 98% by mol or less, and even more preferably 97% by mol or less, of a total number of moles of the carboxylic acid component and the alcohol component which are raw material monomers for the polycondensation resin component, from the viewpoint of increasing crystallinity of the composite resin, thereby increasing low-temperature fusing ability and durability of the toner.

A total number of moles of the aliphatic dicarboxylic acid compound having 9 or more carbon atoms and 14 or less carbon atoms and the aliphatic diol having 9 or more carbon atoms and 14 or less carbon atoms is preferably 80% by mol or more, more preferably 90% by mol or more, and even more preferably 95% by mol or more, and preferably 100% by mol or less, more preferably substantially 100% by mol, and even more preferably 100% by mol, of a total number of moles of the dicarboxylic or higher polycarboxylic acid compound in the carboxylic acid component and the dihydric or higher polyhydric alcohols in the alcohol component which are raw material monomers for the polycondensation resin component, from the viewpoint of increasing crystallinity of the composite resin, thereby increasing low-temperature fusing ability and durability of the toner.

The equivalent ratio of the carboxylic acid component to the alcohol component in the polycondensation resin component (COOH group or groups/OH group or groups) is preferably 0.70 or more, and more preferably 0.85 or more, and preferably 1.10 or less, and more preferably 1.05 or less, from the viewpoint of adjusting a softening point of the composite resin.

The polycondensation reaction of the raw material monomers for the polycondensation resin component can be carried out in an inert gas atmosphere at a temperature of from 130° to 230° C. or so, optionally in the presence of an esterification catalyst, a polymerization inhibitor or the like. The esterification catalyst includes tin compounds such as dibutyltin oxide and tin(II) 2-ethylhexanoate; titanium compounds such as titanium diisopropylate bistriethanolaminate; and the like, and an esterification promoter which can be used together with the esterification catalyst includes gallic acid, and the like. The amount of the esterification catalyst used is preferably 0.01 parts by mass or more, and more preferably 0.1 parts by mass or more, and preferably 1.5 parts by mass or less, and more preferably 1.0 part by mass or less, based on 100 parts by mass of a total amount of the alcohol component and the carboxylic acid component. The amount of the esterification promoter used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component.

As the raw material monomers for the styrenic resin component, at least styrene or a styrene derivative such as α-methylstyrene or vinyltoluene (hereinafter, the styrene and styrene derivatives are collectively referred to as "styrenic compound") is used.

The content of the styrenic compound is preferably 70% by mass or more, more preferably 80% by mass or more, and even more preferably 90% by mass or more, and preferably 100% by mass or less, and more preferably substantially 100% by mass, of the raw material monomers for the styrenic resin component, from the viewpoint of low-temperature fusing ability and durability of the toner.

The raw material monomers for the styrenic resin component to be used other than the styrenic compound include alkyl (meth)acrylates; ethylenically unsaturated monoolefins such as ethylene and propylene; diolefins such as butadiene; halovinyls such as vinyl chloride; vinyl esters such as vinyl acetate and vinyl propionate; ethylenically monocarboxylic acid esters such as dimethylaminoethyl (meth)acrylate; vinyl ethers such as vinyl methyl ether; vinylidene halides such as vinylidene chloride; N-vinyl compounds such as N-vinylpyrrolidone; and the like.

The raw material monomers for the styrenic resin component to be used other than the styrenic compound can be used in combination of two or more kinds. The term "(meth)acrylate" as used herein means acrylate and/or methacrylate.

Among the raw material monomers for the styrenic resin component to be used other than the styrenic compound, alkyl (meth)acrylates are preferred, from the viewpoint of improving low-temperature fusing ability of the toner. The number of carbon atoms of the alkyl group in the alkyl (meth)acrylate is preferably 1 or more, and more preferably 8 or more, and preferably 22 or less, and more preferably 18 or less, from the above viewpoint. Here, the number of carbon atoms of the alkyl ester refers to the number of carbon atoms derived from the alcohol component constituting the ester.

Specific examples of the alkyl (meth)acrylate include methyl (meth)acrylate, ethyl (meth)acrylate, (iso)propyl (meth)acrylate, 2-hydroxyethyl (meth)acrylate, (iso or tertiary)butyl (meth)acrylate, 2-ethylhexyl (meth)acrylate, (iso)octyl (meth)acrylate, (iso)decyl (meth)acrylate, (iso) stearyl (meth)acrylate, and the like. Here, the expression "(iso or tertiary)" or "(iso)" means to embrace both cases where these groups are present and cases where they are absent, and in the cases where these groups are absent, they are normal form. Also, the expression "(meth)acrylate" means to embrace both acrylate and methacrylate.

The content of the alkyl (meth)acrylate is preferably 30% by mass or less, more preferably 20% by mass or less, and even more preferably 10% by mass or less, and preferably 0% by mass or more, and more preferably 0% by mass, of the raw material monomers for the styrenic resin component, from the viewpoint of improving durability of the toner.

The addition polymerization reaction of the raw material monomers for the styrenic resin component can be carried out, for example, according to a conventional method, in the presence of a polymerization initiator such as dicumyl peroxide, a crosslinking agent or the like, in the presence of an organic solvent or in the absence of a solvent, and the temperature conditions are preferably 110° C. or higher, and more preferably 140° C. or higher, and preferably 200° C. or lower, and more preferably 170° C. or lower.

When an organic solvent is used during the addition polymerization reaction, xylene, toluene, methyl ethyl ketone, acetone or the like can be used. The amount of the organic solvent used is preferably 10 parts by mass or more and 50 parts by mass or less, based on 100 parts by mass of the raw material monomers for the styrenic resin component.

It is preferable that the crystalline composite resin C is a resin obtained from the raw material monomers for the polycondensation resin component and the raw material monomers for the styrenic resin component, and further a dually reactive monomer, capable of reacting with both of the raw material monomers for the polycondensation resin component and the raw material monomers for the styrenic resin component (a hybrid resin), from the viewpoint of improving low-temperature fusing ability and durability of the toner. Therefore, upon the polymerization of the raw material monomers for the polycondensation resin component and the raw material monomers for the styrenic resin component to obtain a crystalline composite resin C, it is preferable that the polycondensation reaction and/or the addition polymerization reaction is carried out in the presence of the dually reactive monomer. By the presence of the dually reactive monomer, the crystalline composite resin C is a resin in which the polycondensation resin component and the styrenic resin component are bound via a constituting unit derived from the dually reactive monomer (a hybrid resin), whereby the polycondensation resin component and the styrenic resin component are more finely and homogeneously dispersed.

Specifically, it is preferable that the crystalline composite resin C is a resin obtained by polymerizing (i) raw material monomers for a polycondensation resin component, containing an alcohol component containing an aliphatic diol having 9 or more carbon atoms and 14 or less carbon atoms and a carboxylic acid component containing an aliphatic dicarboxylic acid compound having 9 or more carbon atoms and 14 or less carbon atoms; (ii) raw material monomers for a styrenic resin component; and (iii) a dually reactive monomer capable of reacting with both of the raw material monomers for the polycondensation resin component and the raw material monomers for the styrenic resin component.

It is preferable that the dually reactive monomer is a compound having in its molecule at least one functional group selected from the group consisting of a hydroxyl group, a carboxy group, an epoxy group, a primary amino group and a secondary amino group, preferably a hydroxyl group and/or a carboxy group, and more preferably a carboxy group, and an ethylenically unsaturated bond. By using the dually reactive monomer described above, dispersibility of the resin forming a dispersion phase can be even more improved. The dually reactive monomer is preferably at least one member selected from the group consisting of acrylic acid, methacrylic acid, fumaric acid, maleic acid, and maleic anhydride. The dually reactive monomer is more preferably acrylic acid, methacrylic acid or fumaric acid, from the viewpoint of reactivities of the polycondensation reaction and the addition polymerization reaction. However, when used together with a polymerization inhibitor, a polycarboxylic acid compound having an ethylenically unsaturated bond such as fumaric acid functions as raw material monomers for a polycondensation resin component. In this case, fumaric acid or the like is a raw material monomer for the polycondensation resin component, not a dually reactive monomer.

The amount of the dually reactive monomer used, based on 100 mol in a total of the alcohol component for the polycondensation resin component, is preferably 1 mol or more, more preferably 2 mol or more, and even more preferably 4 mol or more, from the viewpoint of low-temperature fusing ability. In addition, the amount used is preferably 30 mol or less, more preferably 20 mol or less, and even more preferably 10 mol or less, from the viewpoint of improving durability of the toner.

In addition, the amount of the dually reactive monomer used, based on 100 parts by mass in a total of the raw material monomers for the styrenic resin component, is preferably 1 part by mass or more, and more preferably 2 parts by mass or more, from the viewpoint of low-temperature fusing ability. Also, the amount used is preferably 30 parts by mass or less, more preferably 20 parts by mass or less, and even more preferably 10 parts by mass or less, from the viewpoint of enhancing dispersibility between the styrenic resin component and the polycondensation resin component, thereby improving durability of the toner. Here, the total of the raw material monomers for the styrenic resin component includes a polymerization initiator.

Specifically, it is preferable that a hybrid resin obtained by using a dually reactive monomer is produced by the following method. It is preferable that the dually reactive monomer is used in the addition polymerization reaction together with the raw material monomers for the styrenic resin component, from the viewpoint of improving durability and low-temperature fusing ability of the toner.

(i) Method including the steps of (A) carrying out a polycondensation reaction of raw material monomers for a polycondensation resin component; and thereafter (B) carrying out an addition polymerization reaction of raw materials monomers for a styrenic resin component and a dually reactive monomer In this method, the step (A) is carried out under reaction temperature conditions appropriate for a polycondensation reaction, a reaction temperature is then lowered, and the step (B) is carried out under temperature conditions appropriate for an addition polymerization reaction. It is preferable that the raw material monomers for the styrenic resin component and the dually reactive monomer are added to a reaction system at a temperature appropriate for an addition polymerization reaction. The dually reactive monomer reacts in the addition polymerization reaction and at the same time reacts with the polycondensation resin component.

After the step (B), a reaction temperature is raised again, raw material monomers and the like for a polycondensation resin component such as a trivalent or higher polyvalent monomer serving as a crosslinking agent are optionally added to the polymerization system, whereby the polycondensation reaction of the step (A) and the reaction with the dually reactive monomer can be further progressed.

(ii) Method including the steps of (B) carrying out an addition polymerization reaction of raw material monomers for a styrenic resin component and a dually reactive monomer, and thereafter (A) carrying out a polycondensation reaction of raw material monomers for a polycondensation resin component In this method, the step (B) is carried out under reaction temperature conditions appropriate for an addition polymerization reaction, a reaction temperature is then raised, and the step (A) a polycondensation reaction is carried out under reaction temperature conditions appropriate for the polycondensation reaction. The dually reactive monomer is involved in a polycondensation reaction as well as the addition polymerization reaction.

The raw material monomers for the polycondensation resin component may be present in a reaction system during the addition polymerization reaction, or the raw material monomers for the polycondensation resin component may be added to a reaction system under temperatures conditions appropriate for the polycondensation reaction. In the former case, the progress of the polycondensation reaction can be adjusted by adding an esterification catalyst at a temperature appropriate for the polycondensation reaction.

(iii) Method including the steps of carrying out reactions under conditions of concurrently progressing the step (A) a polycondensation reaction of raw material monomers for a polycondensation resin component; and the step (B) an addition polymerization reaction of raw materials monomers for a styrenic resin component and a dually reactive monomer In this method, it is preferable that the steps (A) and (B) are concurrently carried out under reaction temperature conditions appropriate for an addition polymerization reaction, a reaction temperature is raised, and under temperature conditions appropriate for the polycondensation reaction, raw material monomers for the polycondensation resin component of a trivalent or higher polyvalent monomer serving as a crosslinking agent are optionally added to a polymerization system, and the step (A) a polycondensation reaction is further carried out. During the process, the polycondensation reaction alone can be progressed by adding a radical polymerization inhibitor under temperature conditions appropriate for the polycondensation reaction. The dually reactive monomer is involved in a polycondensation reaction as well as the addition polymerization reaction.

In the above method (i), a polycondensation resin that is previously polymerized may be used in place of the step (A) carrying out a polycondensation reaction. In the above method (iii), when a reaction is carried out under conditions that the steps (A) and (B) are concurrently progressed, a mixture containing raw material monomers for the styrenic resin component can be added dropwise to a mixture containing raw material monomers for the polycondensation resin component to react.

It is preferable that the above methods (i) to (iii) are carried out in the same vessel.

A mass ratio of the polycondensation resin component to the styrenic resin component in the crystalline composite resin C (polycondensation resin component/styrenic resin component) is preferably 95/5 or less, more preferably 90/10 or less, and even more preferably 85/15 or less, from the viewpoint of durability, and the mass ratio is preferably 60/40 or more, more preferably 70/30 or more, and even more preferably 75/25 or more, from the viewpoint of low-temperature fusing ability. Here, in the above calculation, the mass of the polycondensation resin component is an amount obtained by removing the amount of reaction water dehydrated by the polycondensation reaction (calculation value) from the mass of the raw material monomers for the polycondensation resin used, and the amount of the dually reactive monomer is included in the amount of the raw material monomers for the polycondensation resin component. In addition, the amount of the styrenic resin component is the amount of the raw material monomers for the styrenic resin component, and the amount of the polymerization initiator is included in the amount of the raw material monomers for the styrenic resin component.

The softening point of the crystalline composite resin C is preferably 70° C. or higher, more preferably 75° C. or higher, and even more preferably 80° C. or higher, from the viewpoint of durability and storage property of the toner. The softening point is preferably 105° C. or lower, more preferably 100° C. or lower, and even more preferably 96° C. or lower, from the viewpoint of low-temperature fusing ability of the toner.

In addition, the melting point (highest temperature of endothermic peak) of the crystalline composite resin C is preferably 55° C. or higher, more preferably 65° C. or higher, and even more preferably 70° C. or higher, from the viewpoint of improving durability and storage property of the toner. Also, the melting point is preferably 140° C. or lower, more preferably 120° C. or lower, even more preferably 110° C. or lower, and even more preferably 100° C. or lower, from the viewpoint of improving low-temperature fusing ability of the toner.

The loss modulus (G") of the crystalline composite resin C at 140° C. is preferably 400 or less, more preferably 350 or less, even more preferably 300 or less, even more preferably 250 or less, even more preferably 200 or less, even more preferably 100 or less, even more preferably 50 or less, even more preferably 30 or less, and even more preferably 20 or less, from the viewpoint of low-temperature fusing ability and control of wrapping-jam of sheets during fusing. The loss modulus is preferably 5 or more, more preferably 10 or more, even more preferably 30 or more, even more preferably 50 or more, even more preferably 100 or more, even more preferably 130 or more, even more preferably 150 or more, even more preferably 180 or more, even more preferably 200 or more, and even more preferably 220 or more, from the viewpoint of durability.

The method for adjusting a loss modulus (G") includes a method for lowering a loss modulus (G") by using a monocarboxylic acid compound or a monohydric alcohol, or shortening the reaction time, a method for making a loss modulus (G") longer by extending the reaction time, and the like.

The toner of the present invention may contain a crystalline resin other than the crystalline composite resin C, but the content of the above crystalline composite resin C in the crystalline resin is preferably 50% by mass or more, more preferably 80% by mass or more, and even more preferably 90% by mass or more, from the viewpoint of low-temperature fusing ability and durability of the toner. Also, the content is preferably 100% by mass or less, and more preferably 100% by mass.

The content of the crystalline composite resin C in the resin binder is preferably 5% by mass or more, more preferably 7% by mass or more, and even more preferably 8% by mass or more, from the viewpoint of improving low-temperature fusing ability of the toner. Also, the content is preferably 40% by mass or less, more preferably 30% by mass or less, even more preferably 20% by mass or less, and even more preferably 15% by mass or less, from the viewpoint of improving durability of the toner.

The amorphous composite resin AC contained in the amorphous resin is a resin containing a polycondensation resin component and a styrenic resin component, wherein the polycondensation resin component is obtained by polycondensing an alcohol component and a carboxylic acid component containing an aromatic dicarboxylic acid compound.

The polycondensation resin component includes polyesters, polyester-polyamides, and the like, and the polyesters are preferred, from the viewpoint of improving low-temperature fusing ability and durability of the toner.

It is preferable that the polyester is obtained by polycondensing an alcohol component containing a dihydric or higher polyhydric alcohol and a carboxylic acid component containing a dicarboxylic or higher polycarboxylic acid compound.

It is preferable that the alcohol component contains an alkylene oxide adduct of bisphenol A represented by the formula (I):

(I)

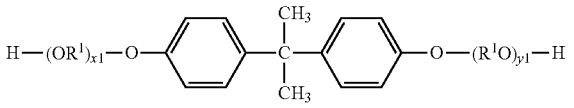

wherein $R^1O$ and $OR^1$ are an oxyalkylene group, wherein $R^1$ is an ethylene group and/or a propylene group; and each of x1 and y1 is a positive number showing an average number of moles of an alkylene oxide added, wherein a value of the sum of x1 and y1 is preferably 1 or more, and more preferably 1.5 or more, and preferably 16 or less, more preferably 8 or less, and even more preferably 4 or less, from the viewpoint of low-temperature fusing ability and durability of the toner.

The alkylene oxide adduct of bisphenol A represented by the formula (I) includes a propylene oxide adduct of bisphenol A where $R^1O$ is propylene oxide in the formula (I) such as polyoxypropylene(2.2)-2,2-bis(4-hydroxyphenyl) propane; an ethylene oxide adduct of bisphenol A where $R^1O$ is ethylene oxide in the formula (I) such as polyoxyethylene(2.2)-2,2-bis(4-hydroxyphenyl)propane; and the like.

The content of the alkylene oxide adduct of bisphenol A represented by the formula (I) in the alcohol component for the amorphous composite resin AC is preferably 70% by mol or more, more preferably 80% by mol or more, and even more preferably 90% by mol or more, from the viewpoint of low-temperature fusing ability and durability of the toner. In addition, the content is preferably 100% by mol or less, more preferably substantially 100% by mol, and even more preferably 100% by mol.

Other alcohol components include aromatic diols other than the alkylene oxide adduct of bisphenol A; aliphatic diols such as ethylene glycol, 1,2-propanediol, 1,3-propanediol, 1,4-butanediol, 1,5-pentanediol, 1,6-hexanediol, 1,4-butenediol, 1,3-butanediol, and neopentyl glycol; trihydric or higher polyhydric alcohols such as glycerol; and the like.

The carboxylic acid component contains an aromatic dicarboxylic acid compound, from the viewpoint of durability of the toner and environmental stability of electric charges of the toner.

The aromatic dicarboxylic acid compound includes phthalic acid, isophthalic acid, and terephthalic acid; acid anhydrides of these acids, and alkyl(1 to 3 carbon atoms) esters of these acids, and the like, among which terephthalic acid is preferred. In the present invention, the carboxylic acid compound includes not only free acids but also anhydrides which form acids when decomposed during the reaction, and alkyl esters having from 1 to 3 carbon atoms.

The content of the aromatic dicarboxylic acid compound in the carboxylic acid component for the amorphous composite resin AC is preferably 50% by mol or more, more preferably 70% by mol or more, and even more preferably 80% by mol or more, and preferably 100% by mol or less, from the viewpoint of durability and environmental stability of electric charges of the toner. In addition, in the carboxylic acid component for the amorphous composite resin AC, the content is preferably 70% by mol or more, more preferably 80% by mol or more, and even more preferably 90% by mol or more, and preferably 100% by mol or less, and more preferably 100% by mol, of the dicarboxylic acid compound, from the viewpoint of durability and environmental stability of electric charges of the toner.

Other carboxylic acid components include aliphatic dicarboxylic acids such as oxalic acid, malonic acid, maleic acid, fumaric acid, citraconic acid, itaconic acid, glutaconic acid, succinic acid, adipic acid, and succinic acids substituted with an alkyl group having 1 or more and 30 or less carbon atoms or an alkenyl group having 2 or more and 30 or less carbon atoms; alicyclic dicarboxylic acids such as cyclohexanedicarboxylic acid; tricarboxylic or higher polycarboxylic acids such as trimellitic acid and pyromellitic acid; anhydrides of these acids, and alkyl(1 to 3 carbon atoms) esters thereof; rosins; rosins modified with fumaric acid, maleic acid, acrylic acid, or the like; and the like.

The content of the tricarboxylic or higher polycarboxylic acid compound is preferably 10 mol or less, more preferably 5 mol or less, and even more preferably 3 mol or less, and preferably 0.5 mol or more, and more preferably 1 mol or more, based on 100 mol of the alcohol component, from the viewpoint of lowering the softening point, thereby improving compatibility with the crystalline composite resin C, and improving low-temperature fusing ability, durability, and wrapping-jam of sheets during fusing of the toner.

Here, the alcohol component may contain a monohydric alcohol, and the carboxylic acid component may contain a monocarboxylic acid compound in proper amounts, from the viewpoint of adjusting the molecular weight or the like.

The equivalent ratio of the carboxylic acid component to the alcohol component in the polycondensation resin component (COOH group or groups/OH group or groups) is preferably 0.70 or more, and more preferably 0.75 or more, and preferably 1.00 or less, and more preferably 0.95 or less, from the viewpoint of adjusting the softening point of the composite resin.

The polycondensation reaction of the raw material monomers for the polycondensation resin component can be carried out in an inert gas atmosphere at a temperature of 180° C. or higher and 250° C. or lower or so, optionally in the presence of an esterification catalyst, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The esterification promoter which can be used together with the esterification catalyst includes gallic acid, and the like. The amount of the esterification catalyst used is preferably 0.01 parts by mass or more, and more preferably 0.1 parts by mass or more, and preferably 1.5 parts by mass or less, and more preferably 1.0 part by mass or less, based on 100 parts by mass of a total amount of the alcohol component and the carboxylic acid component. The amount of the esterification promoter used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component.

As the raw material monomers for the styrenic resin component, at least styrene or a styrene derivative such as α-methylstyrene or vinyltoluene (hereinafter, the styrene and styrene derivatives are collectively referred to as "styrenic compound") is used.

The content of the styrenic compound in the raw material monomers for the styrenic resin component is preferably 50% by mass or more, more preferably 60% by mass or more, even more preferably 70% by mass or more, and even more preferably 75% by mass or more, from the viewpoint of durability, and the content is preferably 95% by mass or less, more preferably 90% by mass or less, and even more preferably 87% by mass or less, from the viewpoint of low-temperature fusing ability.

The raw material monomers for the styrenic resin component to be used other than the styrenic compound include alkyl (meth)acrylates; ethylenically unsaturated monoolefins such as ethylene and propylene; diolefins such as butadiene; halovinyls such as vinyl chloride; vinyl esters such as vinyl acetate and vinyl propionate; ethylenically monocarboxylic acid esters such as dimethylaminoethyl (meth)acrylate; vinyl ethers such as vinyl methyl ether; vinylidene halides such as vinylidene chloride; N-vinyl compounds such as N-vinylpyrrolidone; and the like.

The raw material monomers for the styrenic resin component to be used other than the styrenic compound can be used in combination of two or more kinds. The term "(meth)acrylate" as used herein means acrylate and/or methacrylate.

Among the raw material monomers for the styrenic resin component to be used other than the styrenic compound, alkyl (meth)acrylates are preferred, from the viewpoint of improving low-temperature fusing ability of the toner. The number of carbon atoms of the alkyl group in the alkyl (meth)acrylate is preferably 1 or more, and more preferably 8 or more, and preferably 22 or less, and more preferably 18 or less, from the above viewpoint. Here, the number of carbon atoms of the alkyl ester refers to the number of carbon atoms derived from the alcohol component constituting the ester.

Specific examples of the alkyl (meth)acrylate include methyl (meth)acrylate, ethyl (meth)acrylate, (iso)propyl (meth)acrylate, 2-hydroxyethyl (meth)acrylate, (iso or tertiary)butyl (meth)acrylate, 2-ethylhexyl (meth)acrylate, (iso)octyl (meth)acrylate, (iso)decyl (meth)acrylate, (iso) stearyl (meth)acrylate, and the like. Here, the expression "(iso or tertiary)" or "(iso)" means to embrace both cases where these groups are present and cases where they are absent, and in the cases where these groups are absent, they are normal form. Also, the expression "(meth)acrylate" means to embrace both acrylate and methacrylate.

The content of the alkyl (meth)acrylate in the raw material monomers for the styrenic resin component is preferably 5% by mass or more, more preferably 10% by mass or more, and even more preferably 13% by mass or more, from the viewpoint of low-temperature fusing ability, and the content is preferably 50% by mass or less, more preferably 40% by mass or less, even more preferably 30% by mass or less, and even more preferably 25% by mass or less, from the same viewpoint.

Here, a resin obtained by subjecting raw material monomers containing a styrenic compound and an alkyl (meth) acrylate to addition polymerization is also referred to as a styrene-(meth)acrylic resin.

The addition polymerization reaction of the raw material monomers for the styrenic resin component can be carried out according to a conventional method, for example, in the presence of a polymerization initiator such as dicumyl peroxide, a crosslinking agent or the like, in the presence of an organic solvent or in the absence of a solvent, and the temperature conditions are preferably 110° C. or higher, and more preferably 140° C. or higher, and preferably 200° C. or lower, and more preferably 170° C. or lower.

When an organic solvent is used during the addition polymerization reaction, xylene, toluene, methyl ethyl ketone, acetone or the like can be used. The amount of the organic solvent used is preferably 10 parts by mass or more and 50 parts by mass or less, based on 100 parts by mass of the raw material monomers for the styrenic resin component.

It is preferable that the amorphous composite resin AC is a resin (a hybrid resin) obtained from the raw material monomers for the polycondensation resin component and the raw material monomers for the styrenic resin component, and further a dually reactive monomer, capable of reacting with both of the raw material monomers for the polycondensation resin component and the raw material monomers for the styrenic resin component, from the viewpoint of improving durability and low-temperature fusing ability of the toner. Therefore, upon the polymerization of the raw material monomers for the polycondensation resin component and the raw material monomers for the styrenic resin component to obtain an amorphous composite resin AC, it is preferable that the polycondensation reaction and/or the addition polymerization reaction is carried out in the presence of the dually reactive monomer. By the presence of the dually reactive monomer, the amorphous composite resin AC is a resin (a hybrid resin) in which the polycondensation resin component and the styrenic resin component are bound via a constituting unit derived from the dually reactive monomer, whereby the polycondensation resin component and the styrenic resin component are more finely and homogeneously dispersed.

Specifically, it is preferable that the amorphous composite resin AC is a resin obtained by polymerizing (i') raw material monomers for a polycondensation resin component, containing an alcohol component containing an alkylene oxide adduct of bisphenol A represented by the formula (I) and a carboxylic acid component containing an aromatic dicarboxylic acid compound; (ii') raw material monomers for a styrenic resin component; and (iii') a dually reactive monomer capable of reacting with both of the raw material monomers for the polycondensation resin component and the raw material monomers for the styrenic resin component, from the viewpoint of improving durability and low-temperature fusing ability of the toner.

It is preferable that the dually reactive monomer is a compound having in its molecule at least one functional group selected from the group consisting of a hydroxyl group, a carboxy group, an epoxy group, a primary amino group and a secondary amino group, preferably a hydroxyl group and/or a carboxy group, and more preferably a carboxy group, and an ethylenically unsaturated bond. By using the dually reactive monomer described above, dispersibility of the resin forming a dispersion phase can be even more improved. It is preferable that the dually reactive monomer is at least one member selected from the group consisting of acrylic acid, methacrylic acid, fumaric acid, maleic acid, and maleic anhydride, and the dually reactive monomer is more preferably acrylic acid, methacrylic acid or fumaric acid, from the viewpoint of reactivities of the polycondensation reaction and the addition polymerization reaction. However, when used together with a polymerization inhibitor, a polycarboxylic acid compound having an ethylenically unsaturated bond such as fumaric acid functions as raw material monomers for a polycondensation resin component. In this case, fumaric acid or the like is a raw material monomer for the polycondensation resin component, not a dually reactive monomer.

The amount of the dually reactive monomer used, based on 100 mol in a total of the alcohol component for the polycondensation resin component, is preferably 1 mol or more, more preferably 2 mol or more, and even more preferably 3 mol or more, from the viewpoint of low-temperature fusing ability. The amount used is preferably 20 mol or less, more preferably 10 mol or less, and even more preferably 7 mol or less, from the viewpoint of improving durability of the toner, thereby controlling the generation of filming to a photoconductor.

In addition, the amount of the dually reactive monomer used, based on 100 parts by mass in a total of the raw material monomers for the styrenic resin component, is preferably 1 part by mass or more, and more preferably 2 parts by mass or more, from the viewpoint of low-temperature fusing ability. The amount used is preferably 30 parts by mass or less, more preferably 20 parts by mass or less, and even more preferably 10 parts by mass or less, from the viewpoint of enhancing dispersibility between the styrenic resin component and the polycondensation resin component, thereby improving durability of the toner. Here, the total of the raw material monomers for the styrenic resin component includes a polymerization initiator.

The method for producing a hybrid resin using a dually reactive monomer is the same as that of the crystalline composite resin C.

A mass ratio of the polycondensation resin component to the styrenic resin component in the amorphous composite resin AC (polycondensation resin component/styrenic resin component) is preferably 60/40 or more, more preferably 70/30 or more, and even more preferably 75/25 or more, from the viewpoint of low-temperature fusing ability, and the mass ratio is preferably 95/5 or less, more preferably 90/10 or less, and even more preferably 85/15 or less, from the viewpoint of durability. Here, in the above calculation, the mass of the polycondensation resin component is an amount obtained by removing the amount of reaction water dehydrated by the polycondensation reaction (calculation value) from the mass of the raw material monomers for the polycondensation resin used, and the amount of the dually reactive monomer is included in the amount of the raw material monomers for the polycondensation resin component. In addition, the amount of the styrenic resin component is the amount of the raw material monomers for the styrenic resin component, and the amount of the polymerization initiator is included in the amount of the raw material monomers for the styrenic resin component.

The softening point of the amorphous composite resin AC is preferably 80° C. or higher, more preferably 85° C. or higher, even more preferably 90° C. or higher, even more preferably 95° C. or higher, and even more preferably 100° C. or higher, from the viewpoint of durability of the toner. In addition, the softening point is preferably 125° C. or lower, more preferably 120° C. or lower, even more preferably lower than 120° C., and even more preferably 117° C. or lower, from the viewpoint of low-temperature fusing ability of the toner. When two or more kinds of amorphous composite resins AC are contained, it is preferable that a weighted average of the softening point is within the above range.

It is preferable that the softening point of the amorphous composite resin AC is higher than the softening point of the crystalline composite resin C, from the viewpoint of low-temperature fusing ability, durability, and control of wrapping-jam of sheets during fusing. The difference in softening points between the amorphous composite resin AC and the crystalline composite resin C is preferably 50° C. or less, more preferably 40° C. or less, even more preferably 30° C. or less, even more preferably 26° C. or less, and even more preferably 23° C. or less, from the viewpoint of low-temperature fusing ability, durability, and control of wrapping-jam of sheets upon fusing, and the difference is preferably 5° C. or more, more preferably 10° C. or more, even more preferably 15° C. or more, and even more preferably 18° C. or more, from the viewpoint of low-temperature fusing ability and control of wrapping-jam of sheets upon fusing. When the amorphous composite resins AC and the crystalline composite resins C are each composed of plural resins, a difference in softening points obtained by a weighted average of each softening point is used.

The highest temperature of endothermic peak of the amorphous composite resin AC is preferably 50° C. or higher, more preferably 55° C. or higher, and even more preferably 60° C. or higher, from the viewpoint of improving durability of the toner and from the viewpoint of improving storage property of the toner. In addition, the highest temperature of endothermic peak is preferably 100° C. or lower, more preferably 90° C. or lower, and even more preferably 80° C. or lower, from the viewpoint of improving low-temperature fusing ability of the toner.

The glass transition temperature of the amorphous composite resin AC is preferably 50° C. or higher, and more preferably 55° C. or higher, from the viewpoint of improving durability of the toner, and from the viewpoint of improving storage property of the toner. In addition, the glass transition temperature is preferably 80° C. or lower, more preferably 75° C. or lower, and even more preferably 70° C. or lower, from the viewpoint of improving low-temperature fusing ability of the toner. Here, the glass transition temperature is a physical property intrinsically owned by an amorphous phase, and is distinguished from the highest temperature of endothermic peak.

The acid value of the amorphous composite resin AC is preferably 40 mgKOH/g or less, more preferably 30 mgKOH/g or less, and even more preferably 25 mgKOH/g or less, and preferably 1 mgKOH/g or more, and more preferably 2 mgKOH/g or more, from the viewpoint of improving environmental stability of the electric charges of the toner.

The amorphous polyester AP is a resin obtained by polycondensing an alcohol component and a carboxylic acid component containing an aromatic dicarboxylic acid compound.

It is preferable that the polyester is obtained by polycondensing an alcohol component containing a dihydric or higher polyhydric alcohol and a carboxylic acid component containing a dicarboxylic or higher polycarboxylic acid compound.

It is preferable that the alcohol component contains an alkylene oxide adduct of bisphenol A represented by the formula (II):

(II)

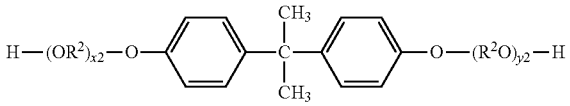

wherein $R^2O$ and $OR^2$ are an oxyalkylene group, wherein $R^2$ is an ethylene group and/or a propylene group; and each of x2 and y2 is a positive number showing an average number of moles of an alkylene oxide added, wherein a value of the sum of x2 and y2 is preferably 1 or more, and more preferably 1.5 or more, and preferably 16 or less, more preferably 8 or less, and even more preferably 4 or less, from the viewpoint of low-temperature fusing ability and durability. The alkylene oxide adduct of bisphenol A represented by the formula (II) usable in the amorphous polyester AP may be identical or different from the alkylene oxide adduct of bisphenol A represented by the formula (I) usable in the amorphous composite resin AC.

The alkylene oxide adduct of bisphenol A represented by the formula (II) includes a propylene oxide adduct of bisphenol A where $R^2O$ is propylene oxide in the formula (II) such as polyoxypropylene(2.2)-2,2-bis(4-hydroxyphenyl)propane; an ethylene oxide adduct of bisphenol A where $R^2O$ is ethylene oxide in the formula (II) such as polyoxyethylene(2.2)-2,2-bis(4-hydroxyphenyl)propane; and the like.

The content of the alkylene oxide adduct of bisphenol A represented by the formula (II) in the alcohol component for the amorphous polyester AP is preferably 70% by mol or more, more preferably 80% by mol or more, and even more preferably 90% by mol or more, from the viewpoint of low-temperature fusing ability and durability of the toner. In addition, the content is preferably 100% by mol or less, more preferably substantially 100% by mol, and even more preferably 100% by mol.

Other alcohol components include aromatic diols other than the alkylene oxide adduct of bisphenol A; aliphatic diols such as ethylene glycol, 1,2-propanediol, 1,3-propanediol, 1,4-butanediol, 1,5-pentanediol, 1,6-hexanediol, 1,4-butenediol, 1,3-butanediol, and neopentyl glycol; trihydric or higher polyhydric alcohols such as glycerol; and the like.

The carboxylic acid component contains an aromatic dicarboxylic acid compound, from the viewpoint of improving durability of the toner and environmental stability of electric charges of the toner.

The aromatic dicarboxylic acid compound includes phthalic acid, isophthalic acid, and terephthalic acid; acid anhydrides of these acids and alkyl(1 to 3 carbon atoms) esters of these acids, and the like, among which terephthalic acid is preferred. In the present invention, the carboxylic acid compound includes not only free acids but also anhydrides which form acids when decomposed during the reaction, and alkyl esters having from 1 to 3 carbon atoms.

The content of the aromatic dicarboxylic acid compound in the carboxylic acid component for the amorphous polyester AP is preferably 10% by mol or more, more preferably 15% by mol or more, and even more preferably 20% by mol or more, from the viewpoint of durability, and the content is preferably 90% by mol or less, more preferably 80% by mol or less, and even more preferably 70% by mol or less, from the viewpoint of low-temperature fusing ability.

In addition, it is preferable that the carboxylic acid component further contains an aliphatic dicarboxylic acid compound, from the viewpoint of low-temperature fusing ability.

The aliphatic dicarboxylic acid compound includes succinic acid (number of carbon atoms: 4), fumaric acid (number of carbon atoms: 4), glutaric acid (number of carbon atoms: 5), adipic acid (number of carbon atoms: 6), suberic acid (number of carbon atoms: 8), azelaic acid (number of carbon atoms: 9), sebacic acid (number of carbon atoms: 10), dodecanedioic acid (number of carbon atoms: 12), tetradecanedioic acid (number of carbon atoms: 14), succinic acid having an alkyl group having from 1 to 20 carbon atoms or an alkenyl group having from 2 to 20 carbon atoms at a side chain, acid anhydrides of these acids, alkyl esters having from 1 to 3 carbon atoms thereof, and the like.

The chained hydrocarbon group in the aliphatic dicarboxylic acid compound may be linear or branched, and the number of carbon atoms of the main chain of the aliphatic dicarboxylic acid compound is preferably 4 or more. In addition, the number of carbon atoms of the main chain is preferably 14 or less, more preferably 12 or less, and even more preferably 8 or less, from the viewpoint of availability. Here, in the present invention, the carboxylic acid compound includes not only free acids but also anhydrides which form acids when decomposed during the reaction, and alkyl esters having from 1 to 3 carbon atoms. However, the number of carbon atoms of the alkyl group of the alkyl ester moiety is not included in the number of carbon atoms of the aliphatic dicarboxylic acid compound. The number of carbon atoms of the main chain is the number of carbons positioned linearly between the two carboxylic acids, and succinic acid having an alkyl group having from 1 to 20 carbon atoms or an alkenyl group having from 2 to 20 carbon atoms in a side chain mentioned above is an aliphatic dicarboxylic acid compound having the number of carbon atoms of the main chain of 4.

The content of the aliphatic dicarboxylic acid compound in the carboxylic acid component for the amorphous polyester AP is preferably 5% by mol or more, more preferably 10% by mol or more, and even more preferably 12% by mol or more, from the viewpoint of low-temperature fusing ability, and the content is preferably 70% by mol or less, more preferably 60% by mol or less, and even more preferably 50% by mol or less, from the viewpoint of durability.

Other carboxylic acid components include alicyclic dicarboxylic acids such as cyclohexanedicarboxylic acid; tricarboxylic or higher polycarboxylic acids such as trimellitic acid and pyromellitic acid; anhydrides of these acids, and alkyl(1 to 3 carbon atoms) esters thereof; rosins; rosins modified with fumaric acid, maleic acid, acrylic acid, or the like, and the like.

The content of the tricarboxylic or higher polycarboxylic acid compound, based on 100 mol of the alcohol component, is preferably 5 mol or more, more preferably 10 mol or more, and even more preferably 12 mol or more, from the viewpoint of improving the softening point, and controlling wrapping-jam of sheets during fusing, and the content is preferably 30 mol or less, and more preferably 25 mol or less, from the viewpoint of low-temperature fusing ability.

Here, the alcohol component may contain a monohydric alcohol, and the carboxylic acid component may contain a monocarboxylic acid compound in proper amounts, from the viewpoint of adjusting the molecular weights.

The equivalent ratio of the carboxylic acid component to the alcohol component (COOH group or groups/OH group or groups) is preferably 0.70 or more, and more preferably 0.75 or more, and preferably 1.05 or less, and more preferably 0.98 or less, from the viewpoint of adjusting the softening point of the amorphous polyester AP.

The polycondensation reaction of the raw material monomers can be carried out in an inert gas atmosphere at a temperature of 180° C. or higher and 250° C. or lower or so, optionally in the presence of an esterification catalyst, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The esterification promoter which can be used together with the esterification catalyst includes gallic acid, and the like. The amount of the esterification catalyst used is preferably 0.01 parts by mass or more, and more preferably 0.1 parts by mass or more, and preferably 1.5 parts by mass or less, and more preferably 1.0 part by mass or less, based on 100 parts by mass of a total amount of the alcohol component and the carboxylic acid component. The amount of the esterification promoter used is preferably 0.001 parts by mass or more, and more preferably 0.01 parts by mass or more, and preferably 0.5 parts by mass or less, and more preferably 0.1 parts by mass or less, based on 100 parts by mass of a total amount of the alcohol component and the carboxylic acid component.

The softening point of the amorphous polyester AP is preferably 120° C. or higher, more preferably 125° C. or higher, and even more preferably 130° C. or higher, from the viewpoint of improving durability of the toner. The softening point is preferably 170° C. or lower, more preferably 160° C. or lower, and even more preferably 150° C. or lower, from the viewpoint of low-temperature fusing ability. When two or more kinds of amorphous polyester AP are contained, it is preferable that a weighted average of the softening point is within the above range.

The softening point of the amorphous polyester AP is higher than the softening point of the amorphous composite resin AC. The difference in softening points between the amorphous polyester AP and the amorphous composite resin AC is 10° C. or more, preferably 15° C. or more, more preferably 20° C. or more, and even more preferably 25° C. or more, from the viewpoint of low-temperature fusing ability, durability, and control of wrapping-jam of sheets upon fusing, and the difference is 50° C. or less, preferably 40° C. or less, more preferably 35° C. or less, and even more preferably 30° C. or less, from the same viewpoint. When the amorphous polyester AP and the amorphous composite resin AC are each composed of plural resins, a difference in softening points obtained by a weighted average of each softening point is used.

The highest temperature of endothermic peak of the amorphous polyester AP is preferably 50° C. or higher, more preferably 55° C. or higher, and even more preferably 60° C. or higher, from the viewpoint of improving durability of the toner, and from the viewpoint of improving storage property of the toner. In addition, the highest temperature of endothermic peak is preferably 100° C. or lower, more preferably 90° C. or lower, and even more preferably 80° C. or lower, from the viewpoint of improving low-temperature fusing ability of the toner.

The glass transition temperature of the amorphous polyester AP is preferably 50° C. or higher, more preferably 55° C. or higher, and even more preferably 60° C. or higher, from the viewpoint of improving durability of the toner, and from the viewpoint of improving heat-resistant storage property of the toner. In addition, the glass transition temperature is preferably 80° C. or lower, more preferably 75° C. or lower, and even more preferably 70° C. or lower, from the viewpoint of improving low-temperature fusing ability of the toner. Here, the glass transition temperature is a physical property intrinsically owned by an amorphous phase, and is distinguished from the highest temperature of endothermic peak.

The acid value of the amorphous polyester AP is preferably 40 mgKOH/g or less, more preferably 30 mgKOH/g or less, and even more preferably 25 mgKOH/g or less, and preferably 1 mgKOH/g or more, and more preferably 2 mgKOH/g or more, from the viewpoint of improving environmental stability of the electric charges of the toner.

A mass ratio of the amorphous polyester AP to the amorphous composite resin AC (amorphous polyester AP/amorphous composite resin AC) is preferably 10 or less, more preferably 7 or less, even more preferably 5 or less, even more preferably 3 or less, even more preferably 2 or less, even more preferably 1 or less, even more preferably 0.5 or less, and even more preferably 0.3 or less, from the viewpoint of low-temperature fusing ability. The mass ratio is preferably 0.1 or more, more preferably 0.3 or more, even more preferably 0.5 or more, even more preferably 1 or more, even more preferably 2 or more, and even more preferably 3 or more, from the viewpoint of control of wrapping-jam of sheets during fusing. In addition, the mass ratio is preferably 0.1 or more, more preferably 0.3 or more, even more preferably 0.5 or more, and even more preferably 1 or more, from the viewpoint of durability, and the mass ratio is preferably 10 or less, more preferably 7 or less, even more preferably 5 or less, even more preferably 3 or less, and even more preferably 2 or less, from the same viewpoint.

Therefore, a mass ratio of the amorphous polyester AP to the amorphous composite resin AC (amorphous polyester AP/amorphous composite resin AC) is preferably 0.1 or more, more preferably 0.3 or more, even more preferably 0.5 or more, and even more preferably 1 or more, and preferably 10 or less, more preferably 7 or less, even more preferably 5 or less, even more preferably 3 or less, and even more preferably 2 or less, from the viewpoint of low-temperature fusing ability, control of wrapping-jam of sheets during fusing, and durability.

A mass ratio of the crystalline composite resin C to a total amount of the amorphous composite resin AC and the amorphous polyester AP (the crystalline composite resin C/a total amount of amorphous composite resin AC and amorphous polyester AP) is preferably 2/98 or more, more preferably 5/95 or more, even more preferably 7/93 or more, even more preferably 10/90 or more, and even more preferably 15/85 or more, from the viewpoint of low-temperature fusing ability, and the mass ratio is preferably 30/70 or less, more preferably 25/75 or less, even more preferably 20/80 or less, even more preferably 15/85 or less, even more preferably 10/90 or less, and even more preferably 7/93 or less, from the viewpoint of durability.

The toner of the present invention may contain an amorphous resin other than the amorphous composite resin AC and the amorphous polyester AP, including, for example, a composite resin, a vinyl resin, an epoxy resin, a polycarbonate resin, a polyurethane resin, or the like. A total content of the amorphous composite resin AC and the amorphous polyester AP in the amorphous resin is preferably 50% by mass or more, more preferably 80% by mass or more, and even more preferably 90% by mass or more, from the viewpoint of durability, low-temperature fusing ability, and control of wrapping-jam of sheets during fusing of the toner. The total content is preferably 100% by mass or less, and more preferably 100% by mass.

A mass ratio of the crystalline resin to the amorphous resin (crystalline resin/amorphous resin) is preferably 2/98 or more, more preferably 5/95 or more, even more preferably 7/93 or more, even more preferably 10/90 or more, and even more preferably 15/85 or more, from the viewpoint of low-temperature fusing ability, and the mass ratio is preferably 30/70 or less, more preferably 25/75 or less, even more preferably 20/80 or less, even more preferably 15/85 or less, even more preferably 10/90 or less, and even more preferably 7/93 or less, from the viewpoint of durability.

The releasing agent includes hydrocarbon waxes such as polypropylene wax, polyethylene wax, polypropylene-polyethylene copolymer wax, microcrystalline wax, paraffin waxes, Fischer-Tropsch wax, and sazole wax, preferably aliphatic hydrocarbon waxes, and oxides thereof; ester waxes such as carnauba wax, montan wax, deacidified waxes thereof, and fatty acid ester waxes; fatty acid amides, fatty acids, higher alcohols, metal salts of fatty acids, and the like. These releasing agents can be used alone or in a mixture of two or more kinds. It is preferable that the releasing agent contains an ester wax, from the viewpoint of low-temperature fusing ability, durability, and control of wrapping-jam of sheets during fusing of the toner. It is preferable that an aliphatic hydrocarbon wax is contained together with an ester wax, from the viewpoint of releasing property, and a mass ratio of the ester wax to the aliphatic hydrocarbon wax (ester wax/aliphatic hydrocarbon wax) is preferably from 10/1 to 1/3, and more preferably from 5/1 to 1/2.

The melting point of the releasing agent is preferably 60° C. or higher, and more preferably 70° C. or higher, from the viewpoint of durability of the toner, and the melting point is preferably 160° C. or lower, more preferably 140° C. or lower, even more preferably 120° C. or lower, and even more preferably 110° C. or lower, from the viewpoint of low-temperature fusing ability.

The content of the releasing agent, based on 100 parts by mass of the resin binder, is preferably 0.5 parts by mass or more, more preferably 1 part by mass or more, and even more preferably 1.5 parts by mass or more, from the viewpoint of low-temperature fusing ability and offset resistance of the toner. In addition, the content is preferably 10 parts by mass or less, more preferably 8 parts by mass or less, and even more preferably 7 parts by mass or less, from the viewpoint of durability of the toner.

The toner for electrophotography of the present invention may contain, in addition to the resin binder and the releasing agent, a colorant, a charge control agent, and the like.

As the colorant, all of the dyes, pigments and the like which are used as colorants for toners can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, disazo yellow, or the like can be used. The toner of the present invention may be any of black toners and color toners. As the colorant, Phthalocyanine Blue 15:3 (P.B. 15:3), Phthalocyanine Blue 15:4 (P.B. 15:4), and carbon blacks are preferred, from the viewpoint of improving durability of the toner, and from the viewpoint of improving low-temperature fusing ability and storage property of the toner.

The content of the colorant, based on 100 parts by mass of the resin binder, is preferably 0.5 parts by mass or more, and more preferably 1.0 part by mass or more, from the viewpoint of improving optical density of the toner. Also, the content is preferably 10 parts by mass or less, more preferably 8 parts by mass or less, and even more preferably 7 parts by mass or less, from the viewpoint of improving durability and low-temperature fusing ability of the toner.

The charge control agent may contain, but not particularly limited to, any of positively chargeable charge control agents and negatively chargeable charge control agents.

The positively chargeable charge control agent includes Nigrosine dyes, for example, "Nigrosine Base EX," "OIL BLACK BS," "OIL BLACK SO," "BONTRON N-01," "BONTRON N-04," "BONTRON N-07," "BONTRON N-09," "BONTRON N-11" (hereinabove manufactured by Orient Chemical Industries Co., Ltd.), and the like; triphenylmethane-based dyes containing a tertiary amine as a side chain; quaternary ammonium salt compounds, for example, "BONTRON P-51" (manufactured by Orient Chemical Industries Co., Ltd.), cetyltrimethylammonium bromide, "COPY CHARGE PX VP435" (manufactured by Clariant, Ltd.), and the like; polyamine resins, for example, "AFP-B" (manufactured by Orient Chemical Industries Co., Ltd.), and the like; imidazole derivatives, for example, "PLZ-2001," "PLZ-8001" (hereinabove manufactured by Shikoku Chemicals Corporation), and the like; styrene-acrylic resins, for example, "FCA-701PT" (manufactured by FUJIKURAKASEI CO., LTD.), and the like.

In addition, the negatively chargeable charge control agent includes metal-containing azo dyes, for example, "VARIFAST BLACK 3804," "BONTRON S-31, "BONTRON S-32," "BONTRON S-34," "BONTRON S-36" (hereinabove manufactured by Orient Chemical Industries Co., Ltd.), "AIZEN SPILON BLACK TRH," "T-77" (manufactured by Hodogaya Chemical Co., Ltd.), and the like; metal compounds of benzilic acid compounds, for example, "LR-147," "LR-297" (hereinabove manufactured by Japan Carlit Co., Ltd.), and the like; metal compounds of salicylic acid compounds, for example, "BONTRON E-81," "BONTRON E-84," "BONTRON E-88," "BONTRON E-304" (hereinabove manufactured by Orient Chemical Industries Co., Ltd.), "TN-105" (manufactured by Hodogaya Chemical Co., Ltd.), and the like; copper phthalocyanine dyes; quaternary ammonium salts, for example, "COPY CHARGE NX VP434" (manufactured by Clariant, Ltd.), nitroimidazole derivatives, and the like; organometallic compounds and the like.

The content of the charge control agent, based on 100 parts by mass of the resin binder, is preferably 0.01 parts by mass or more, and more preferably 0.2 parts by mass or more, from the viewpoint of electric stability of the toner. Also, the content is preferably 10 parts by mass or less, more preferably 5 parts by mass or less, even more preferably 3 parts by mass or less, and even more preferably 2 parts by mass or less, from the same viewpoint.

In the toner of present invention, an additive such as a magnetic particulate, a fluidity improver, an electric conductivity modifier, a reinforcing filler such as a fibrous material, an antioxidant, an anti-aging agent, or a cleanability improver may be further properly used.

The toner of the present invention may be a toner obtained by any of the conventionally known methods such as a melt-kneading method, an emulsion phase-inversion method, and a polymerization method, and a pulverized toner produced by the melt-kneading method is preferred, from the viewpoint of productivity and dispersibility of a colorant. In a case of a pulverized toner produced by a melt-kneading method, a toner can be produced by homogeneously mixing raw materials such as a resin binder, a colorant, a releasing agent and a charge control agent with a mixer such as a Henschel mixer, thereafter melt-kneading the mixture with a closed kneader, a single-screw or twin-screw extruder, an open-roller type kneader or the like, cooling, pulverizing, and classifying the product.

In the toner of the present invention, it is preferable to use an external additive, in order to improve transferability. The external additive includes fine inorganic particles of silica, alumina, titania, zirconia, tin oxide, zinc oxide, and the like, and fine organic particles of resin particles such as fine melamine resin particles and fine polytetrafluoroethylene resin particles. Two or more kinds of the external additives may be used in combination. Among them, silica is preferred, and a hydrophobic silica that is hydrophobically treated is more preferred, from the viewpoint of transferability of the toner.

The hydrophobic treatment agent for hydrophobically treating the surface of silica particles includes hexamethyldisilazane (HMDS), dimethyldichlorosilane (DMDS), a silicone oil, octyltriethoxysilane (OTES), methyltriethoxysilane, and the like.

The average particle size of the external additive is preferably 10 nm or more, and more preferably 15 nm or more, from the viewpoint of chargeability, fluidity, and transferability of the toner. In addition, the average particle size is preferably 250 nm or less, more preferably 200 nm or less, and even more preferably 90 nm or less, from the same viewpoint.

The content of the external additive, based on 100 parts by mass of the toner before the treatment with the external additive, is preferably 0.05 parts by mass or more, more preferably 0.1 parts by mass or more, and even more preferably 0.3 parts by mass or more, from the viewpoint of chargeability, fluidity, and transferability of the toner. In addition, the content is preferably 5 parts by mass or less, and more preferably 3 parts by mass or less, from the same viewpoint.

The volume-median particle size ($D_{50}$) of the toner of the present invention is preferably 3 μm or more, and more preferably 4 μm or more, and preferably 15 μm or less, and more preferably 10 μm or less. The volume-median particle size ($D_{50}$) as used herein means a particle size of which cumulative volume frequency calculated on a volume percentage is 50% counted from the smaller particle sizes. Also, in a case where the toner is treated with an external additive, the volume-median particle size is regarded as a volume-median particle size of the toner particles before the treatment with an external additive.

The toner of the present invention can be used as a toner for monocomponent development, or a toner may be mixed with a carrier to be used a two-component developer.

With regard to the embodiments described above, the present invention further discloses the following toner for electrophotography.

<1> A toner for electrophotography containing a resin binder containing a crystalline resin and an amorphous resin, and a releasing agent, wherein the crystalline resin contains a crystalline composite resin C containing a polycondensation resin component and a styrenic resin component, wherein the polycondensation resin component is obtained by polycondensing an alcohol component containing an aliphatic diol having 9 or more carbon atoms and 14 or less carbon atoms, and a carboxylic acid component containing an aliphatic dicarboxylic acid compound having 9 or more carbon atoms and 14 or less carbon atoms, and wherein the amorphous resin contains an amorphous composite resin AC containing a polycondensation resin component and a styrenic resin component, wherein the polycondensation resin component is obtained by polycondensing an alcohol component and a carboxylic acid component containing an aromatic dicarboxylic acid compound, and an amorphous polyester AP obtained by polycondensing an alcohol component and a carboxylic acid component containing an aromatic dicarboxylic acid compound, wherein a softening point of the amorphous polyester AP is higher than a softening point of the amorphous composite resin AC, wherein a difference in softening points between the amorphous polyester AP and the amorphous composite resin AC is 10° C. or more and 50° C. or less.

<2> The toner for electrophotography according to the above <1>, wherein the polycondensation resin component for the crystalline resin C is a polyester.

<3> The toner for electrophotography according to the above <1> or <2>, wherein the number of carbon atoms of the aliphatic diol contained in the alcohol component for the polycondensation resin component for the crystalline resin C is 10 or more, preferably 12 or more, and more preferably 12.

<4> The toner for electrophotography according to any one of the above <1> to <3>, wherein the content of the aliphatic diol having 9 or more carbon atoms and 14 or less carbon atoms in the crystalline resin C is 70% by mol or more, preferably 90% by mol or more, and more preferably 95% by mol or more, and 100% by mol or less, preferably substantially 100% by mol, and more preferably 100% by mol, of a total amount of the dihydric or higher polyhydric alcohol of the alcohol component for the polycondensation resin component.

<5> The toner for electrophotography according to any one of the above <1> to <4>, wherein the number of carbon atoms of the aliphatic dicarboxylic acid compound contained in the carboxylic acid component for the polycondensation resin component for the crystalline resin C is 10 or more, and 12 or less, preferably 10 or less, and more preferably 10.

<6> The toner for electrophotography according to any one of the above <1> to <5>, wherein the content of the aliphatic dicarboxylic acid compound having 9 or more carbon atoms and 14 or less carbon atoms in the crystalline resin C is 70% by mol or more, preferably 90% by mol or more, and more preferably 95% by mol or more, and preferably 100% by mol or less, more preferably substantially 100% by mol, and even more preferably 100% by mol, of a total amount of the dicarboxylic or higher polycarboxylic acid compound of the carboxylic acid component for the polycondensation resin component.

<7> The toner for electrophotography according to any one of the above <1> to <6>, wherein the raw material monomers for the polycondensation resin component for the crystalline composite resin C contain at least any of an aliphatic monocarboxylic acid compound having 8 or more carbon atoms and 22 or less carbon atoms and an aliphatic monohydric alcohol having 8 or more carbon atoms and 22 or less carbon atoms.

<8> The toner for electrophotography according to the above <7>, wherein the number of carbon atoms of the aliphatic monohydric alcohol and the aliphatic monocarboxylic acid compound is 12 or more, and preferably 14 or more, and 20 or less, and more preferably 18 or less.

<9> The toner for electrophotography according to the above <7> or <8>, wherein a total content of the aliphatic monohydric alcohol having 8 or more carbon atoms and 22 or less carbon atoms and the aliphatic monocarboxylic acid compound having 8 or more carbon atoms and 22 or less carbon atoms in the raw material monomers for the polycondensation resin component for the crystalline composite resin C, in other words, a total amount of the alcohol component and the carboxylic acid component, is 1% by mol or more, preferably 2% by mol or more, and more preferably 3% by mol or more, and 12% by mol or less, preferably 10% by mol or less, more preferably 8% by mol or less, and even more preferably 6% by mol or less.

<10> The toner for electrophotography according to any one of the above <1> to <9>, wherein a total number of moles of the aliphatic dicarboxylic acid compound having 9 or more carbon atoms and 14 or less carbon atoms and the aliphatic diol having 9 or more carbon atoms and 14 or less carbon atoms is 88% by mol or more, preferably 90% by mol or more, more preferably 92% by mol or more, and even more preferably 94% by mol or more, and 100% by mol or less, preferably 99% by mol or less, more preferably 98% by mol or less, and even more preferably 97% by mol or less, of a total number of moles of the carboxylic acid component and the alcohol component which are raw material monomers for the polycondensation resin component for the crystalline composite resin C.

<11> The toner for electrophotography according to any one of the above <1> to <10>, wherein a total number of moles of the aliphatic dicarboxylic acid compound having 9 or more carbon atoms and 14 or less carbon atoms and the aliphatic diol having 9 or more carbon atoms and 14 or less carbon atoms is 80% by mol or more, preferably 90% by mol or more, and more preferably 95% by mol or more, and 100% by mol or less, preferably substantially 100% by mol, and more preferably 100% by mol, of a total number of moles of the dicarboxylic or higher polycarboxylic acid compound in the carboxylic acid component and the dihydric or higher polyhydric alcohols in the alcohol component which are raw material monomers for the polycondensation resin component for the crystalline composite resin C.

<12> The toner for electrophotography according to any one of the above <1> to <11>, wherein the styrenic resin component for the crystalline composite resin C contains a styrenic compound, and wherein the content of the styrenic compound is preferably 70% by mass or more, more preferably 80% by mass or more, and even more preferably 90% by mass or more, and preferably 100% by mass or less, and more preferably substantially 100% by mass, of the raw material monomers for the styrenic resin component for the crystalline composite resin C.

<13> The toner for electrophotography according to any one of the above <1> to <12>, wherein the crystalline composite resin C is a resin obtained by polymerizing (i) raw material monomers for a polycondensation resin component, containing an alcohol component containing an aliphatic diol having 9 or more carbon atoms and 14 or less carbon atoms and a carboxylic acid component containing an aliphatic dicarboxylic acid compound having 9 or more carbon atoms and 14 or less carbon atoms; (ii) raw material monomers for a styrenic resin component; and (iii) a dually reactive monomer capable of reacting with both of the raw material monomers for the polycondensation resin component and the raw material monomers for the styrenic resin component.

<14> The toner for electrophotography according to the above <13>, wherein the amount of the dually reactive monomer used, based on 100 mol in a total of the alcohol component for the polycondensation resin component for the crystalline composite resin C, is 1 mol or more, preferably 2 mol or more, and more preferably 4 mol or more, and 30 mol or less, preferably 20 mol or less, and more preferably 10 mol or less.

<15> The toner for electrophotography according to the above <13> or <14>, wherein the amount of the dually reactive monomer used, based on 100 parts by mass in a total of the raw material monomers for the styrenic resin component, is 1 part by mass or more, and preferably 2 parts by mass or more, and 30 parts by mass or less, preferably 20 parts by mass or less, and more preferably 10 parts by mass or less.

<16> The toner for electrophotography according to any one of the above <1> to <15>, wherein a mass ratio of the polycondensation resin component to the styrenic resin component in the crystalline composite resin C (polycondensation resin component/styrenic resin component) is 95/5 or less, preferably 90/10 or less, and more preferably 85/15 or less, and 60/40 or more, preferably 70/30 or more, and more preferably 75/25 or more.

<17> The toner for electrophotography according to any one of the above <1> to <16>, wherein the softening point of the crystalline composite resin C is 70° C. or higher, preferably 75° C. or higher, and more preferably 80° C. or higher, and 105° C. or lower, preferably 100° C. or lower, and more preferably 96° C. or lower.

<18> The toner for electrophotography according to any one of the above <1> to <17>, wherein the loss modulus (G") of the crystalline composite resin C at 140° C. is 400 or less, preferably 350 or less, more preferably 300 or less, even more preferably 250 or less, even more preferably 200 or less, even more preferably 100 or less, even more preferably 50 or less, even more preferably 30 or less, and even more preferably 20 or less.

<19> The toner for electrophotography according to any one of the above <1> to <18>, wherein the loss modulus (G") of the crystalline composite resin C at 140° C. is 5 or more, preferably 10 or more, more preferably 30 or more, even more preferably 50 or more, even more preferably 100 or more, even more preferably 130 or more, even more preferably 150 or more, even more preferably 180 or more, even more preferably 200 or more, and even more preferably 220 or more.

<20> The toner for electrophotography according to any one of the above <1> to <19>, wherein the content of the crystalline composite resin C in the resin binder is 5% by mass or more, preferably 7% by mass or more, and more preferably 8% by mass or more, and 40% by mass or less, preferably 30% by mass or less, more preferably 20% by mass or less, and even more preferably 15% by mass or less.

<21> The toner for electrophotography according to any one of the above <1> to <20>, wherein the polycondensation resin component for the amorphous composite resin AC is a polyester.

<22> The toner for electrophotography according to any one of the above <1> to <21>, wherein the alcohol component for the polycondensation resin component for the amorphous composite resin AC contains an alkylene oxide adduct of bisphenol A represented by the formula (I).

<23> The toner for electrophotography according to the above <22>, wherein the content of the alkylene oxide adduct of bisphenol A represented by the formula (I) is 70% by mol or more, preferably 80% by mol or more, and more preferably 90% by mol or more, and 100% by mol or less, preferably substantially 100% by mol, and more preferably 100% by mol, of the alcohol component for the amorphous composite resin AC.

<24> The toner for electrophotography according to any one of the above <1> to <23>, wherein the content of the aromatic dicarboxylic acid compound contained in the carboxylic acid component for the amorphous composite resin AC is 50% by mol or more, preferably 70% by mol or more, and more preferably 80% by mol or more, and 100% by mol or less of the carboxylic acid component for the amorphous composite resin AC.

<25> The toner for electrophotography according to any one of the above <1> to <24>, wherein the content of the aromatic dicarboxylic acid compound contained in the carboxylic acid component for the amorphous composite resin AC is 70% by mol or more, preferably 80% by mol or more, and more preferably 90% by mol or more, and 100% by mol or less, and preferably 100% by mol, of the dicarboxylic acid compound contained in the carboxylic acid component for the amorphous composite resin AC.

<26> The toner for electrophotography according to any one of the above <1> to <25>, wherein the styrenic resin component for the amorphous composite resin AC contains a styrenic compound, and wherein the content of the styrenic compound is 50% by mass or more, preferably 60% by mass or more, more preferably 70% by mass or more, and even more preferably 75% by mass or more, and 95% by mass or less, preferably 90% by mass or less, and more preferably 87% by mass or less, of the raw material monomers for the styrenic resin component for the amorphous composite resin AC.

<27> The toner for electrophotography according to the above <26>, wherein the styrenic resin component for the amorphous composite resin AC contains an alkyl (meth) acrylate, and wherein the number of carbon atoms of the alkyl group in the alkyl (meth)acrylate is preferably 1 or more, and more preferably 8 or more, and preferably 22 or less, and more preferably 18 or less.

<28> The toner for electrophotography according to the above <27>, wherein the content of the alkyl (meth)acrylate in the raw material monomers for the styrenic resin component for the amorphous composite resin AC is 5% by mass or more, preferably 10% by mass or more, and more preferably 13% by mass or more, and 50% by mass or less, preferably 40% by mass or less, more preferably 30% by mass or less, and even more preferably 25% by mass or less.

<29> The toner for electrophotography according to any one of the above <1> to <28>, wherein the amorphous composite resin AC is a resin obtained by polymerizing (i') raw material monomers for a polycondensation resin component, containing an alcohol component containing an alkylene oxide adduct of bisphenol A represented by the formula (I) and a carboxylic acid component containing an aromatic dicarboxylic acid compound; (ii') raw material monomers for a styrenic resin component; and (iii') a dually reactive monomer capable of reacting with both of the raw material monomers for the polycondensation resin component and the raw material monomers for the styrenic resin component.

<30> The toner for electrophotography according to the above <29>, wherein the amount of the dually reactive monomer used, based on 100 mol in a total of the alcohol component for the polycondensation resin component for the amorphous composite resin AC, is 1 mol or more, preferably 2 mol or more, and more preferably 3 mol or more, and 20 mol or less, preferably 10 mol or less, and more preferably 7 mol or less.

<31> The toner for electrophotography according to the above <29> or <30>, wherein the amount of the dually reactive monomer used, based on 100 parts by mass in a total of the raw material monomers for the styrenic resin component for the amorphous composite resin AC, is 1 part by mass or more, and preferably 2 parts by mass or more, and 30 parts by mass or less, preferably 20 parts by mass or less, and more preferably 10 parts by mass or less.

<32> The toner for electrophotography according to any one of the above <1> to <31>, wherein a mass ratio of the polycondensation resin component to the styrenic resin component in the amorphous composite resin AC (polycondensation resin component/styrenic resin component) is 60/40 or more, preferably 70/30 or more, and more preferably 75/25 or more, and 95/5 or less, preferably 90/10 or less, and more preferably 85/15 or less.

<33> The toner for electrophotography according to any one of the above <1> to <32>, wherein the softening point of the amorphous composite resin AC is higher than the softening point of the crystalline composite resin C, and wherein the difference in softening points between the amorphous composite resin AC and the crystalline composite resin C is 50° C. or less, preferably 40° C. or less, more preferably 30° C. or less, even more preferably 26° C. or less, and even more preferably 23° C. or less, and 5° C. or more, preferably 10° C. or more, more preferably 15° C. or more, and even more preferably 18° C. or more.

<34> The toner for electrophotography according to any one of the above <1> to <33>, wherein the alcohol component for the amorphous polyester AP contains an alkylene oxide adduct of bisphenol A represented by the formula (II).

<35> The toner for electrophotography according to the above <34>, wherein the content of the alkylene oxide adduct of bisphenol A represented by the formula (II) is 70% by mol or more, preferably 80% by mol or more, and more preferably 90% by mol or more, and 100% by mol or less, preferably substantially 100% by mol, and more preferably 100% by mol, of the alcohol component for the amorphous polyester AP.

<36> The toner for electrophotography according to any one of the above <1> to <35>, wherein the content of the aromatic dicarboxylic acid compound contained in the carboxylic acid component for the amorphous polyester AP is 10% by mol or more, preferably 15% by mol or more, and more preferably 20% by mol or more, and 90% by mol or less, preferably 80% by mol or less, and more preferably 70% by mol or less, of the carboxylic acid component for the amorphous polyester AP.

<37> The toner for electrophotography according to any one of the above <1> to <36>, wherein the carboxylic acid component for the amorphous polyester AP further contains an aliphatic dicarboxylic acid compound.

<38> The toner for electrophotography according to the above <37>, wherein the number of carbon atoms of the main chain of the aliphatic dicarboxylic acid compound is 4 or more, and 14 or less, preferably 12 or less, and more preferably 8 or less.

<39> The toner for electrophotography according to the above <37> or <38>, wherein the content of the aliphatic dicarboxylic acid compound is 5% by mol or more, preferably 10% by mol or more, and more preferably 12% by mol or more, and 70% by mol or less, preferably 60% by mol or less, and more preferably 50% by mol or less, of the carboxylic acid component for the amorphous polyester AP.

<40> The toner for electrophotography according to any one of the above <1> to <39>, wherein the difference in softening points between the amorphous polyester AP and the amorphous composite resin AC is 15° C. or more, preferably 20° C. or more, and more preferably 25° C. or more, and 40° C. or less, preferably 35° C. or less, and more preferably 30° C. or less.

<41> The toner for electrophotography according to any one of the above <1> to <40>, wherein the softening point of the amorphous polyester AP is 120° C. or higher, preferably 125° C. or higher, and more preferably 130° C. or higher, and 170° C. or lower, preferably 160° C. or lower, and more preferably 150° C. or lower.

<42> The toner for electrophotography according to any one of the above <1> to <41>, wherein a mass ratio of the amorphous polyester AP to the amorphous composite resin AC (amorphous polyester AP/amorphous composite resin AC) is 0.1 or more, preferably 0.3 or more, more preferably 0.5 or more, and even more preferably 1 or more, and 10 or less, preferably 7 or less, more preferably 5 or less, even more preferably 3 or less, and even more preferably 2 or less.

<43> The toner for electrophotography according to any one of the above <1> to <42>, wherein a mass ratio of the crystalline composite resin C to a total amount of the amorphous composite resin AC and the amorphous polyester AP (the crystalline composite resin C/a total amount of amorphous composite resin AC and amorphous polyester AP) is 2/98 or more, preferably 5/95 or more, more preferably 7/93 or more, even more preferably 10/90 or more, and even more preferably 15/85 or more, and 30/70 or less, preferably 25/75 or less, more preferably 20/80 or less, even more preferably 15/85 or less, even more preferably 10/90 or less, and even more preferably 7/93 or less.

<44> The toner for electrophotography according to any one of the above <1> to <43>, wherein a mass ratio of the crystalline resin to the amorphous resin (crystalline resin/amorphous resin) is 2/98 or more, preferably 5/95 or more, more preferably 7/93 or more, even more preferably 10/90 or more, and even more preferably 15/85 or more, and 30/70 or less, preferably 25/75 or less, more preferably 20/80 or less, even more preferably 15/85 or less, even more preferably 10/90 or less, and even more preferably 7/93 or less.

<45> The toner for electrophotography according to any one of the above <1> to <44>, wherein the melting point of the releasing agent is 60° C. or higher, and preferably 70° C. or higher, and 160° C. or lower, preferably 140° C. or lower, more preferably 120° C. or lower, and even more preferably 110° C. or lower.

<46> The toner for electrophotography according to any one of the above <1> to <45>, wherein the content of the releasing agent, based on 100 parts by mass of the resin binder, is 0.5 parts by mass or more, preferably 1 part by mass or more, and more preferably 1.5 parts by mass or more, and 10 parts by mass or less, preferably 8 parts by mass or less, and more preferably 7 parts by mass or less.

<47> The toner for electrophotography according to any one of the above <1> to <46>, wherein the releasing agent contains an ester wax, and preferably contains an ester wax and an aliphatic hydrocarbon wax, wherein a mass ratio of the ester wax to the aliphatic hydrocarbon wax (ester wax/aliphatic hydrocarbon wax) is preferably from 10/1 to 1/3, and more preferably from 5/1 to 1/2.

<48> The toner for electrophotography according to any one of the above 2<1> to <47>, wherein the softening point of the amorphous composite resin AC is 80° C. or higher, preferably 85° C. or higher, more preferably 90° C. or higher, even more preferably 95° C. or higher, and even more preferably 100° C. or higher, and 125° C. or lower, preferably 120° C. or lower, more preferably lower than 120° C., and even more preferably 117° C. or lower.

The following examples further describe and demonstrate embodiments of the present invention. The examples are given solely for the purposes of illustration and are not to be construed as limitations of the present invention. The physical properties of the resins and the like were measured by the following methods.

[Softening Point of Resin]

The softening point refers to a temperature at which half of the sample flows out, when plotting a downward movement of a plunger of a flow tester "CFT-500D" (manufactured by Shimadzu Corporation), against temperature, in which a 1 g sample is extruded through a nozzle having a die pore size of 1 mm and a length of 1 mm with applying a load of 1.96 MPa thereto with the plunger, while heating the sample so as to raise the temperature at a rate of 6° C./min.

[Highest Temperature of Endothermic Peak of Resin]

Measurements are taken using a differential scanning calorimeter "Q-100" (manufactured by TA Instruments, Japan), by weighing out a 0.01 to 0.02 g sample in an aluminum pan, cooling the sample from room temperature to 0° C. at a cooling rate of 10° C./min, and keeping at 0° C. for one minute. Thereafter, the measurements are taken while heating at a rate of 50° C./min. Of the endothermic peaks observed, a temperature of the peak of the highest temperature side is defined as a highest temperature of endothermic peak.

[Glass Transition Temperature of Resin]

Measurements are taken using a differential scanning calorimeter "DSC Q20" (manufactured by TA Instruments, Japan), by weighing out a 0.01 to 0.02 g sample in an aluminum pan, heating the sample to 200° C., and cooling the sample from that temperature to 0° C. at a cooling rate of 10° C./min. Next, the measurements are taken while heating the sample at a rate of 10° C./min. A temperature of an intersection of the extension of the baseline of equal to or lower than the highest temperature of endothermic peak and the tangential line showing the maximum inclination between the kick-off of the peak and the top of the peak in the above measurement is defined as a glass transition temperature.

[Acid Value of Resin]

The acid value is determined by a method according to JIS K0070 except that only the determination solvent is changed from a mixed solvent of ethanol and ether as defined in JIS K0070 to a mixed solvent of acetone and toluene in a volume ratio of acetone:toluene=1:1.

[Loss Modulus (G") of Resin]

The loss modulus (G") is measured with a measuring apparatus for viscoelasticity (rheometer) ARES (manufactured by TA Instruments) (Strain: 1.0%, frequency: 6.28 rad/sec). Parallel plates having a diameter of 50 mm are heated to 160° C. and held at that state, a 2 g sample is then placed on the parallel plate at 160° C., and interposed between the upper and lower plates. Thereafter, the temperature is lowered to 120° C., and then raised to 160° C. at a rate of 2° C./min to obtain a loss modulus at 140° C.

[Melting Point of Releasing Agent]

Measurements are taken using a differential scanning calorimeter "DSC Q20" (manufactured by TA Instruments, Japan), by weighing out a 0.01 to 0.02 g sample in an aluminum pan, heating the sample to 200° C. at a heating rate of 10° C./min, and cooling the sample from that temperature to −10° C. at a cooling rate of 5° C./min. Next, the measurements are taken while heating the sample to 180° C. at a rate of 10° C./min. A highest temperature of endothermic peak observed in the melting endothermic curve obtained is defined as a melting point of a releasing agent.

[Average Particle Size of External Additive]

The average particle size refers to a number-average particle size, which is defined as a number-average of particle sizes (average of length and breadth) determined for 500 particles from a photograph taken with a scanning electron microscope (SEM).

[Volume-Median Particle Size of Toner]

Measuring Apparatus: Coulter Multisizer II (manufactured by Beckman Coulter, Inc.)

Aperture Diameter: 100 μm

Analyzing Software: Coulter Multisizer AccuComp Ver. 1.19 (manufactured by Beckman Coulter, Inc.)

Electrolytic Solution: Isotone II (manufactured by Beckman Coulter, Inc.)

Dispersion: EMULGEN 109P (manufactured by Kao Corporation), polyoxyethylene lauryl ether, HLB (Griffin): 13.6, is dissolved in the above electrolytic solution so as to have a concentration of 5% by mass to provide a dispersion.

Dispersion Conditions: Ten milligrams of a measurement sample is added to 5 ml of the above dispersion, and the mixture is dispersed for 1 minute with an ultrasonic disperser (name of machine: US-1, manufactured by SND Co., Ltd., output: 80 W). Thereafter, 25 ml of the above electrolytic solution is added to the dispersion, and further dispersed with the ultrasonic disperser for 1 minute, to prepare a sample dispersion.

Measurement Conditions: The above sample dispersion is added to 100 ml of the above electrolytic solution so as to have a concentration at which particle sizes of 30,000 particles can be measured in 20 seconds, and thereafter the 30,000 particles are measured, and a volume-median particle size ($D_{50}$) is obtained from the particle size distribution.

Production Example 1 of Resin [Resin C1]

A 10-liter four-neck flask equipped with a nitrogen inlet tube, a dehydration tube, a stirrer, and a thermocouple was charged with raw material monomers for a polycondensation resin component and an esterification catalyst, as listed in Table 1, and the contents were heated to 160° C., and reacted for 6 hours.

Thereafter, raw material monomers for a styrenic resin and a dually reactive monomer as listed in Table 1 were added dropwise thereto from a dropping funnel over one hour. The addition polymerization reaction was allowed to mature for one hour, while keeping the temperature at 160° C., and raw material monomers for the styrenic resin were removed at 8.3 kPa for one hour. Further, the contents were heated to 200° C. over 8 hours, and reacted at 8.3 kPa for one hour, to provide a crystalline hybrid resin. The physical properties of the resulting resin are shown in Table 1.

Production Example 2 of Resins [Resins C2 to C5]

A 10-liter four-neck flask equipped with a nitrogen inlet tube, a dehydration tube, a stirrer, and a thermocouple was charged with raw material monomers for a polycondensation resin component and an esterification catalyst, as listed in Table 1, and the contents were heated to 160° C., and reacted for 6 hours.

Thereafter, raw material monomers for a styrenic resin and a dually reactive monomer as listed in Table 1 were added dropwise thereto from a dropping funnel over one hour. The addition polymerization reaction was allowed to mature for one hour, while keeping the temperature at 160° C., and raw material monomers for the styrenic resin were removed at 8.3 kPa for one hour. Further, the contents were heated to 200° C. over 8 hours, and reacted at 8.3 kPa for two hours, to provide a crystalline hybrid resin. The physical properties of the resulting resin are shown in Table 1.

Production Example 3 of Resin [Resin C6]

A 10-liter four-neck flask equipped with a nitrogen inlet tube, a dehydration tube, a stirrer, and a thermocouple was charged with raw material monomers and an esterification catalyst, as listed in Table 1, and the contents were heated from 130° to 200° C. in a nitrogen atmosphere over 10 hours, and reacted at 200° C. and 8 kPa for 1 hours, to provide a crystalline polyester. The physical properties of the resulting resin are shown in Table 1.

Production Example 4 of Resins [Resins AC1 to AC5]

A 10-liter four-neck flask equipped with a nitrogen inlet tube, a dehydration tube, a stirrer, and a thermocouple was charged with raw material monomers for a polycondensation resin component other than trimellitic anhydride, and an esterification catalyst as listed in Table 2, and the contents were reacted at 230° C. for 12 hours, and then reacted at 8.3 kPa for one hour.

The temperature was lowered to 160° C., and raw materials for a styrenic resin, a dually reactive monomer, and dicumyl peroxide were added dropwise thereto from a dropping funnel over one hour. The addition polymerization reaction was allowed to mature for one hour, while keeping the temperature at 160° C., and thereafter, the contents were heated to 210° C., and raw material monomers for the styrenic resin were removed at 8.3 kPa for one hour.

Further, trimellitic anhydride was added thereto at 210° C., and the contents were reacted until a desired softening point was reached, to provide an amorphous hybrid resin. The physical properties of the resulting resin are shown in Table 2.

TABLE 1

[Crystalline Resin]

| | Resin C1 | Resin C2 | Resin C3 | Resin C4 | Resin C5 | Resin C6 |
|---|---|---|---|---|---|---|
| Raw Material Monomers | | | | | | |
| Raw Material Monomers for Polycondensation Resin Component | | | | | | |
| 1,12-Dodecanediol | 4,047 g (100) | 4,047 g (100) | — | 3,844 g (100) | 3,844 g (100) | 4,856 g (100) |
| 1,10-Decanediol | — | — | 3,486 g (100) | — | — | — |
| Sebacic Acid | 3,762 g (93) | 3,762 g (93) | 3,762 g (93) | — | 3,420 g (89) | 4,854 g (100) |
| Dodecanedioic Acid | — | — | — | 4,069 g (93) | — | — |
| Terephthalic Acid | — | — | — | — | — | — |
| Lunac S-70V[1)] | — | — | — | — | 428 g (8) | — |
| Dually Reactive Monomer | | | | | | |
| Acrylic Acid | 101 g (7) | 101 g (7) | 101 g (7) | 101 g (7) | 96 g (7) | — |
| Raw Material Monomers for Styrenic Resin Component | | | | | | |
| Styrene | 1,730 g (100) | 1,730 g (100) | 1,607 g (100) | 1,730 g (100) | 1,703 g (100) | — |
| Dicumyl Peroxide (Polymerization Initiator) | 104 g (6) | 104 g (6) | 96 g (6) | 104 g (6) | 102 g (6) | — |
| Esterification Catalyst | | | | | | |
| Tin(II) 2-Ethylhexanoate | 40 g | 40 g | 37 g | 40 g | 39 g | 49 g |
| Polycondensation Resin Component/ Styrenic Resin Component (Mass Ratio)[2)] | 81/19 | 81/19 | 81/19 | 81/19 | 81/19 | — |
| Physical Properties | | | | | | |
| Softening Point [Tm] (° C.) | 88.4 | 92.2 | 87.5 | 95.3 | 89.8 | 90.2 |
| Highest Temperature of Endothermic Peak [Melting Point] (° C.) | 84.1 | 85.0 | 77.6 | 84.5 | 87.6 | 89.5 |
| Crystallinity Index | 1.1 | 1.1 | 1.1 | 1.1 | 1.0 | 1.0 |
| Loss Modulus G" (Pa) at 140° C. | 12.2 | 224.8 | 240.1 | 203.5 | 11.3 | 9.6 |

Note 1) Numerical values inside parenthesis of the raw material monomers for the polycondensation resin component and the dually reactive monomer express the molar ratios when a total amount of the alcohol component is 100.

Note 2) Numerical values inside parenthesis of the raw material monomers for the styrenic resin component and the polymerization initiator express the molar ratios when raw material monomers for the styrenic resin component are 100.

[1)]Manufactured by Kao Corporation, a mixture of monocarboxylic acids having from 14 to 18 carbon atoms (C14: 1%, C16: 30%, C18: 69%)

[2)]The amount of the polycondensation resin component is an amount subtracting the mass of reaction water (calculation value) from a total of the mass of the raw material monomers for the polycondensation resin component including acrylic acid (dually reactive monomer). The amount of the styrenic resin component is a total of the mass of the raw material monomers for the styrenic resin component. The total amount of the raw material monomers for the styrenic resin component includes dibutyl peroxide.

TABLE 2

[Amorphous Composite Resin]

| Raw Material Monomers | Resin AC1 | Resin AC2 | Resin AC3 | Resin AC4 | Resin AC5 |
|---|---|---|---|---|---|
| Raw Material Monomers for Polycondensation Resin Component | | | | | |
| BPA-PO [1)] | 3,920 g (70) | 3,920 g (70) | 3,920 g (70) | 3,920 g (70) | 3,920 g (70) |
| BPA-EO [2)] | 1,560 g (30) | 1,560 g (30) | 1,560 g (30) | 1,560 g (30) | 1,560 g (30) |
| Terephthalic Acid | 2,020 g (76) | 2,060 g (78) | 1,781 g (67) | 1,861 g (70) | 1,941 g (73) |
| Trimellitic Anhydride | 92 g (3) | 61 g (2) | 307 g (10) | 246 g (8) | 184 g (6) |
| Dually Reactive Monomer | | | | | |
| Acrylic Acid | 58 g (5) | 58 g (5) | 58 g (5) | 58 g (5) | 58 g (5) |
| Raw Material Monomers for Styrenic Resin Component | | | | | |
| Styrene | 1,405 g (84) | 1,340 g (80) | 1,401 g (84) | 1,404 g (84) | 1,405 g (84) |
| 2-Ethylhexyl Acrylate | 268 g (16) | 335 g (20) | 267 g (16) | 268 g (16) | 268 g (16) |
| Dicumyl Peroxide (Polymerization Initiator) | 100 g (6) | 101 g (6) | 100 g (6) | 100 g (6) | 100 g (6) |
| Esterification Catalyst | | | | | |
| Tin(II) 2-Ethylhexanoate | 39 g | 38 g | 38 g | 38 g | 38 g |
| Polycondensation Resin Component/ Styrenic Resin Component (Mass Ratio)[3)] | 81/19 | 81/19 | 81/19 | 81/19 | 81/19 |
| Physical Properties | | | | | |
| Softening Point [Tm] (° C.) | 108.3 | 106.0 | 134.1 | 123.8 | 115.6 |
| Glass Transition Temperature (° C.) | 58.6 | 59.1 | 59.4 | 59.5 | 58.0 |
| Highest Temperature of Endothermic Peak (° C.) | 61.3 | 61.4 | 62.1 | 61.9 | 60.2 |
| Softening Point/Highest Temperature of Endothermic Peak | 1.8 | 1.7 | 2.2 | 2.0 | 1.9 |
| Acid Value (mgKOH/g) | 9.3 | 8.5 | 6.1 | 7.6 | 5.9 |

Note

1) Numerical values inside parenthesis of the raw material monomers for the polycondensation resin component and the dually reactive monomer express the molar ratios when a total amount of the alcohol component is 100.

Note

2) Numerical values inside parenthesis of the raw material monomers for the styrenic resin component and the polymerization initiator express the molar ratios when raw material monomers for the styrenic resin component are 100.

1) BPA-PO: Polyoxypropylene(2.2)-2,2-bis(4-hydroxyphenyl)propane

2) BPA-EO: Polyoxyethylene(2.2)-2,2-bis(4-hydroxyphenyl)propane

3) The amount of the polycondensation resin component is an amount subtracting the mass of reaction water (calculation value) from a total of the mass of the raw material monomers for the polycondensation resin component including acrylic acid (dually reactive monomer). The amount of the styrenic resin component is a total of the mass of the raw material monomers for the styrenic resin component. The total amount of the raw material monomers for the styrenic resin component includes dibutyl peroxide.

Production Example 5 of Resins [Resins AP1 and AP2]

A 10-liter four-neck flask equipped with a nitrogen inlet tube, a dehydration tube, a stirrer, and a thermocouple was charged with raw material monomers other than trimellitic anhydride, and an esterification catalyst as listed in Table 3, and the contents were heated to 200° C. in a nitrogen atmosphere, and reacted for 6 hours. Further, the contents were heated to 210° C., trimellitic anhydride was then added thereto, and the contents were reacted at an ambient pressure (101.3 kPa) for one hour, and further reacted at 40 kPa until a desired softening point was reached, to provide an amorphous polyester. The physical properties of the resulting resin are shown in Table 3.

Production Example 6 of Resin [Resin AP3]

A 10-liter four-neck flask equipped with a nitrogen inlet tube, a dehydration tube, a stirrer, and a thermocouple was charged with raw material monomers other than trimellitic anhydride, an esterification catalyst, and a polymerization inhibitor as listed in Table 3, and the contents were heated to 200° C. in a nitrogen atmosphere, and reacted for 6 hours. Further, the contents were heated to 210° C., trimellitic anhydride was then added thereto, and the contents were reacted at an ambient pressure (101.3 kPa) for one hour, and further reacted at 40 kPa until a desired softening point was reached, to provide an amorphous polyester. The physical properties of the resulting resin are shown in Table 3.

TABLE 3

[Amorphous Polyester]

| Raw Material Monomers | Resin AP1 | Resin AP2 | Resin AP3 |
|---|---|---|---|
| Alcohol Component | | | |
| BPA-PO [1)] | 3,920 g (70) | 3,920 g (70) | 3,360 g (60) |

TABLE 3-continued

[Amorphous Polyester]

| Raw Material Monomers | Resin AP1 | Resin AP2 | Resin AP3 |
|---|---|---|---|
| BPA-EO [2] | 1,560 g (30) | 1,560 g (30) | 2,080 g (40) |
| Carboxylic Acid Component | | | |
| Terephthalic Acid | 1,515 g (57) | 1,329 g (50) | 1,196 g (45) |
| Dodecenylsuccinic Acid | 557 g (13) | — | — |
| Adipic Acid | — | 467 g (20) | — |
| Fumaric Acid | — | — | 743 g (40) |
| Trimellitic Anhydride | 461 g (15) | 461 g (15) | 92 g (3) |
| Esterification Catalyst | | | |
| Tin(II) 2-Ethyhexanoate | 40 g | 39 g | 37 g |
| Polymerization Inhibitor | | | |
| Tertiary Butyl Catechol | — | — | 3.7 g |
| Physical Properties | | | |
| Softening Point [Tm] (° C.) | 135.4 | 136.2 | 107.5 |
| Highest Temperature of Endothermic Peak (° C.) | 63.4 | 61.5 | 63.9 |
| Crystallinity Index | 2.1 | 2.2 | 1.7 |
| Glass Transition Temperature (° C.) | 61.2 | 58.9 | 60.5 |
| Acid Value (mgKOH/g) | 8.8 | 7.2 | 4.5 |

Note)
Numerical values inside parenthesis express the molar ratios when a total amount of the alcohol component is 100.
[1] BPA-PO: Polyoxypropylene(2.2)-2,2-bis(4-hydroxyphenyl)propane
[2] BPA-EO: Polyoxyethylene(2.2)-2,2-bis(4-hydroxyphenyl)propane

Examples 1 to 14, and Comparative Examples 1 to 6

One-hundred parts by mass of resin binders as listed in Table 4, 1.0 part by mass of a charge control agent "BONTRON E-304" (manufactured by Orient Chemical Industries Co., Ltd.), 6.0 parts by mass of a colorant "REGAL 330R" (manufactured by Cabot Specialty Chemicals, Inc.), 0.5 parts by mass of a releasing agent "SP-105" (manufactured by S. Kato & CO., Fischer-Tropsch wax, melting point: 105° C.), and 1.5 parts by mass of a releasing agent "WEP-9" (manufactured by NOF CORPORATION, ester wax, melting point: 72° C.) were mixed with a Henschel mixer for one minute, and the mixture was melt-kneaded under the conditions given below.

A co-rotating twin-screw extruder PCM-30 (manufactured by IKEGAI Corporation, a diameter of screw: 2.9 cm, and cross-sectional area of screw: 7.06 $cm^2$) was used. The operating conditions were a barrel setting temperature of 100° C., a rotational speed of the screw of 200 r/min (a peripheral speed of rotations of screw: 0.30 m/sec), and a mixture supplying rate of 10 kg/h (mixture supplying rate per unit cross-sectional area of screw: 1.42 $kg/h \cdot cm^2$).

The kneaded product obtained was cooled, and roughly pulverized with a pulverizer "Rotoplex" (manufactured by Hosokawa Micron Corporation), with a sieve having an opening of 2 mm, to provide a roughly pulverized product having a particle size of 2 mm or less. The roughly pulverized product was subjected to fine pulverization with a DS2 model air classifier (collision plate type, manufactured by Nippon Pneumatic Mfg. Co., Ltd.) by adjusting a pulverization pressure, so as to have a volume-median particle size of 8.0 m. Further, the finely pulverized product obtained was classified with a DSX2 model air classifier (manufactured by Nippon Pneumatic Mfg. Co., Ltd.) by adjusting a static pressure (internal pressure), so as to have a volume-median particle size of 8.5 μm, to provide toner particles.

One hundred parts by mass of the toner particles obtained were mixed with 0.5 parts by mass of a hydrophobic silica "R972" (manufactured by Nippon Aerosil Co., Ltd., hydrophobic treatment agent: DMDS, average particle size: 16 nm) and 1.0 part by mass of a hydrophobic silica "RY-50" (manufactured by Nippon Aerosil Co., Ltd., hydrophobic treatment agent: silicone oil-silica, average particle size: 40 nm) as external additives, with a Henschel mixer (manufactured by MITSUI MINING COMPANY, LIMITED) at 2,100 r/min (peripheral speed: 29 m/sec) for 3 minutes, to provide each of the toners.

Example 15

The same procedures as in Example 1 were carried out except that 2.0 parts by mass of "SARAWAX SX105" (manufactured by SHELL, Fischer Tropsch wax, melting point: 105° C.) was used as a releasing agent in place of "SP-105" and "WEP-9", to provide a toner.

Test Example 1 [Low-Temperature Fusing Ability]

Each of the toners was loaded to a nonmagnetic monocomponent developer device "OKI MICROLINE 5400" (manufactured by Oki Data Corporation), which was modified so that an unfused image can be taken, and a solid image of a square of 2 cm each side was printed out. The unfused image was subjected to a fusing treatment at each temperature, with an external fusing device which was a modified fusing device of the nonmagnetic monocomponent developer device "OKI MICROLINE 3010" (manufactured by Oki Data Corporation) at a rotational speed of a fusing roller of 120 mm/sec, while raising the temperature of the fusing roller temperature from 100° to 230° C. with an increment of 5° C., to provide fused images. The fused images obtained at each fusing temperature were rubbed five reciprocating times with a sand-rubber eraser (ER-502R, manufactured by LION), to which a load of 500 g was applied, and optical densities of the fused image before and after rubbing were measured with an optical densitometer "GREGSPM50" (manufactured by Gretag). A temperature at which a ratio of optical densities before and after rubbing ([optical density after rubbing/optical density before rubbing]×100), initially exceeds 85% is defined as a lowest fusing temperature, and low-temperature fusing ability was evaluated. The results are shown in Table 4. The lower the lowest fusing temperature, the more excellent the low-temperature fusing ability, and the lowest fusing temperature is preferably 140° C. or lower, more preferably 130° C. or lower, and even more preferably 125° C. or lower.

Test Example 2 [Durability]

A 120 g toner was loaded to a nonmagnetic monocomponent developer device "OKI MICROLINE 5400" (manufactured by Oki Data Corporation), and continuous printing was conducted with a print coverage of 3% under environment conditions of a temperature of 25° C. and humidity of 50%. Solid images were printed out every 500 sheets, and whether or not a white streak was generated over the solid images due to filming of the blade was observed, to evaluate durability of the toner. The results are shown in Table 4. The test was halted at a point where the generation of the white streak was confirmed. The larger the number of printed out sheets until the generation of filming of the blade, the more excellent the durability, and the number of sheets is preferably 2,500 sheets or more, more preferably 3,000 sheets or more, even more preferably 3,500 sheets or more, and even more preferably 4,000 sheets or more.

Test Example 3 [Wrapping-Jam of Sheets]

A toner was loaded to an ID cartridge "imaging drum for ML-5400" (manufactured by Oki Data Corporation), and idle-run was performed for one hour at 88 r/min (equivalent to 45 ppm) under the conditions of a temperature of 25° C. and humidity of 50%, and the toner was collected. The idle-run was performed in the same manner for two hours, and the toner was collected. Each of the toners obtained with different idle-run time was loaded to a nonmagnetic monocomponent developer device "OKI MICROLINE 5400" (manufactured by Oki Data Corporation), which was modified so that each of unfused images can be taken, and an unfused image of a solid image of a square having 2 cm each side was printed out. Here, as the printing medium, J sheets (trade name, manufactured by Fuji Xerox Co., Ltd.) were used. The unfused image was subjected to a fusing treatment at a lowest fusing temperature obtained in Test Example 1 with an external fusing device which was a modified fusing device of the nonmagnetic monocomponent developer device "OKI MICROLINE 3010" (manufactured by Oki Data Corporation), to observe wrapping-jam property to the fusing roller. The same procedures were carried out for a total of 10 times, and the control of wrapping-jam of sheets during fusing was evaluated in accordance with the following evaluation criteria. The results are shown in Table 4. The evaluation criteria are preferably B or above, and A is more preferred.

[Evaluation Criteria]

A: No wrapping-jam is generated in both the one-hour and two-hour idle run toner.

B: No wrapping-jam is generated in the one-hour idle-run toner for even one sheet, but wrapping-jam is generated in 1 to 4 sheets in the two-hour idle-run toner.

C: No wrapping-jam is generated in the one-hour idle-run toner for even one sheet, but wrapping-jam is generated in 5 to 10 sheets in the two-hour idle-run toner.

D: Wrapping-jam is generated in both the one-hour and two-hour idle-run toners.

TABLE 4

| | Resin Binder | | | | | | | | | | | | Evaluation of Toner | | |
|---|---|---|---|---|---|---|---|---|---|---|---|---|---|---|---|
| | Amorphous Resin | | | | | | | | | | | | | | |
| | Amorphous Polyester [AP] | | | | Amorphous Composite Resin [AC] | | | | | Crystalline Resin [C] | | | Low-Temp. | | Wrapping-Jam of |
| | Kinds | Parts by Mass | Kinds | Parts by Mass | Kinds | Parts by Mass | Kinds | Parts by Mass | AP/AC (Mass Ratio) | Tm of AP-Tm of AC | Kinds | Parts by Mass | Tm of AC-Tm of C | Fusing Ability (° C.) | Durability (×1000 sheets) | Sheets During Fusing |
| Ex. 1 | AP1 | 50 | — | — | AC1 | 40 | — | — | 1.25 | 27.1 | C1 | 10 | 19.9 | 125 | 3.5 | A |
| Ex. 2 | AP1 | 50 | — | — | AC1 | 40 | — | — | 1.25 | 27.1 | C2 | 10 | 16.1 | 130 | 4.5 | B |
| Ex. 3 | AP1 | 50 | — | — | AC1 | 40 | — | — | 1.25 | 27.1 | C3 | 10 | 20.8 | 130 | 4.0 | B |
| Ex. 4 | AP1 | 50 | — | — | AC1 | 40 | — | — | 1.25 | 27.1 | C4 | 10 | 13.0 | 130 | 4.0 | B |
| Ex. 5 | AP1 | 50 | — | — | AC1 | 40 | — | — | 1.25 | 27.1 | C5 | 10 | 18.5 | 125 | 3.5 | A |
| Ex. 6 | AP2 | 50 | — | — | AC1 | 40 | — | — | 1.25 | 27.9 | C1 | 10 | 19.9 | 125 | 3.0 | A |
| Ex. 7 | AP1 | 50 | — | — | AC2 | 40 | — | — | 1.25 | 29.4 | C1 | 10 | 17.6 | 125 | 3.5 | A |
| Ex. 8 | AP1 | 40 | — | — | AC1 | 40 | AC3 | 10 | 0.80 | 21.9 (weighted average) | C1 | 10 | 25.0 (weighted average) | 125 | 3.0 | B |
| Ex. 9 | AP1 | 20 | — | — | AC1 | 70 | — | — | 0.29 | 27.1 | C1 | 10 | 19.9 | 120 | 2.5 | B |
| Ex. 10 | AP1 | 70 | — | — | AC1 | 20 | — | — | 3.50 | 27.1 | C1 | 10 | 19.9 | 130 | 2.5 | A |
| Ex. 11 | AP1 | 50 | — | — | AC4 | 40 | — | — | 1.25 | 11.6 | C1 | 10 | 35.4 | 130 | 2.5 | B |
| Ex. 12 | AP1 | 50 | — | — | AC5 | 40 | — | — | 1.25 | 19.8 | C1 | 10 | 27.2 | 130 | 3.0 | B |
| Ex. 13 | AP1 | 50 | — | — | AC1 | 45 | — | — | 1.11 | 27.1 | C1 | 5 | 19.9 | 130 | 4.0 | A |
| Ex. 14 | AP1 | 50 | — | — | AC1 | 30 | — | — | 1.67 | 27.1 | C1 | 20 | 19.9 | 120 | 3.0 | A |
| Ex. 15 | AP1 | 50 | — | — | AC1 | 40 | — | — | 1.25 | 27.1 | C1 | 10 | 19.9 | 130 | 3.0 | A |
| Comp. Ex. 1 | AP1 | 50 | — | — | AC1 | 40 | — | — | 1.25 | 27.1 | C6 | 10 | 18.1 | 135 | 1.0 | B |
| Comp. Ex. 2 | — | — | — | — | AC3 | 50 | AC1 | 40 | — | — | C1 | 10 | 34.2 (weighted average) | 125 | 3.5 | D |
| Comp. Ex. 3 | AP1 | 50 | AP3 | 40 | — | — | — | — | — | — | C1 | 10 | — | 135 | 0.5 | B |
| Comp. Ex. 4 | AP1 | 50 | — | — | AC3 | 40 | — | — | 1.25 | 1.3 | C1 | 10 | 45.7 | 140 | 1.5 | C |
| Comp. Ex. 5 | AP1 | 50 | — | — | AC1 | 50 | — | — | 1.00 | 27.1 | — | — | — | 155 | 6.0 | A |
| Comp. Ex. 6 | AP3 | 40 | — | — | AC3 | 50 | — | — | 0.80 | −26.6 | C1 | 10 | 45.7 | 135 | 1.0 | C |

From the comparisons of Examples 1 and 2, it can be seen that one having a lower loss modulus of a crystalline composite resin is more excellent in low-temperature fusing ability and control of wrapping-jam of sheets upon fusing.

From the comparisons of Examples 2 and 3, it can be seen that a toner of Example 2 in which the number of carbon atoms of the aliphatic diol for the crystalline composite resin is 12 is more excellent in durability.

From the comparisons of Examples 2 and 4, it can be seen that a toner of Example 2 in which the number of carbon atoms of the aliphatic dicarboxylic acid compound for the crystalline composite resin is 10 is more excellent in durability.

From the comparisons of Examples 1, 9 and 10, it can be seen that a toner of Example 1 in which the amorphous composite resin/amorphous polyester (mass ratio) is 1.25 (50/40) is more excellent in the balance between low-temperature fusing ability, durability, and control of wrapping-jam of sheets upon fusing.

From the comparisons of Examples 1, 7, 11, and 12 and Comparative Example 4, it can be seen that toners of Examples 1 and 7 in which a difference in softening points between the amorphous composite resin and the amorphous polyester is from 27.1° C. to 29.4° C. are more excellent in low-temperature fusing ability, durability, and control of wrapping-jam of sheets during fusing.

From the comparisons of Examples 1, 13 and 14, it can be seen that Example 1 in which the crystalline composite resin/amorphous resin (a total amount of amorphous composite resin and amorphous polyester) (mass ratio) is 10/90 is more excellent in the balance between low-temperature fusing ability, durability, and control of wrapping-jam of sheets upon fusing.

From the comparisons of Examples 1, 8, 11, and 12, it can be seen that Example 1 in which a difference in softening points between the amorphous composite resin and the crystalline composite resin is 19.6° C. is more excellent in low-temperature fusing ability, durability, and control of wrapping-jam of sheets during fusing.

From the comparisons of Examples 1 and 15, it can be seen that a toner of Example 1 in which the ester wax and the aliphatic hydrocarbon wax are used together, is more excellent in low-temperature fusing ability and durability.

In Comparative Example 1, the crystalline resin is not a composite resin, thereby lowering low-temperature fusing ability and durability.

In Comparative Example 2, both the high-softening point resin and the low-softening point resin in the amorphous resin are composite resins, thereby lowering wrapping-jam of sheets during fusing.

In Comparative Example 3, both the high-softening point resin and the low-softening point resin in the amorphous resin are polyesters, thereby lowering low-temperature fusing ability and durability.

In Comparative Example 4, both the composite resin and the polyester in the amorphous resin are high-softening point resins, thereby lowering low-temperature fusing ability, durability, and wrapping-jam of sheets upon fusing.

In Comparative Example 5, a crystalline composite resin is not used, thereby lowering low-temperature fusing ability.

In Comparative Example 6, the high-softening point resin is a composite resin in the amorphous resin, and the low-softening point resin is a polyester, thereby lowering low-temperature fusing ability, durability, and wrapping-jam of sheets upon fusing.

The toner for electrophotography of the present invention is suitably used in development of latent images or the like which is formed in, for example, electrostatic development method, electrostatic recording method, electrostatic printing method or the like.

The invention claimed is:

1. A toner for electrophotography comprising a resin binder comprising a crystalline resin and an amorphous resin, and a releasing agent, wherein the crystalline resin comprises a crystalline composite resin C comprising a polycondensation resin component and a styrenic resin component, wherein the polycondensation resin component is obtained by polycondensing an alcohol component comprising an aliphatic diol having 9 or more carbon atoms and 14 or less carbon atoms, and a carboxylic acid component comprising an aliphatic dicarboxylic acid compound having 9 or more carbon atoms and 14 or less carbon atoms, and wherein the amorphous resin comprises an amorphous composite resin AC comprising a polycondensation resin component and a styrenic resin component, wherein the polycondensation resin component is obtained by polycondensing an alcohol component and a carboxylic acid component comprising an aromatic dicarboxylic acid compound, and an amorphous polyester AP obtained by polycondensing an alcohol component and a carboxylic acid component comprising an aromatic dicarboxylic acid compound, wherein a softening point of the amorphous polyester AP is higher than a softening point of the amorphous composite resin AC, wherein a difference in softening points between the amorphous polyester AP and the amorphous composite resin AC is 10° C. or more and 50° C. or less.

2. The toner for electrophotography according to claim 1, wherein a difference in softening points between the amorphous polyester AP and the amorphous composite resin AC is 15° C. or more.

3. The toner for electrophotography according to claim 1, wherein a mass ratio of the amorphous polyester AP to the amorphous composite resin AC (amorphous polyester AP/amorphous composite resin AC) is 0.1 or more and 10 or less.

4. The toner for electrophotography according to claim 1, wherein a softening point of the amorphous composite resin AC is higher than a softening point of the crystalline composite resin C, wherein a difference in softening points between the amorphous composite resin AC and the crystalline composite resin C is 50° C. or less.

5. The toner for electrophotography according to claim 1, wherein a mass ratio of the crystalline composite resin C to a total amount of the amorphous composite resin AC and the amorphous polyester AP (crystalline composite resin C/a total amount of amorphous composite resin AC and amorphous polyester AP) is 2/98 or more and 30/70 or less.

6. The toner for electrophotography according to claim 1, wherein a loss modulus of the crystalline composite resin C at 140° C. is 5 or more and 400 or less.

7. The toner for electrophotography according to claim 1, wherein the crystalline composite resin C is a resin obtained by polymerizing (i) raw material monomers for the polycondensation resin component comprising an alcohol component comprising an aliphatic diol having 9 or more carbon atoms and 14 or less carbon atoms, and a carboxylic acid component comprising an aliphatic dicarboxylic acid compound having 9 or more carbon atoms and 14 or less carbon atoms;

(ii) raw material monomers for the styrenic resin component; and (iii) a dually reactive monomer capable of reacting with the raw material monomers for the polycondensation resin component and the raw material monomers for the styrenic resin component.

8. The toner for electrophotography according to claim 1, wherein the amorphous composite resin AC is a resin obtained by polymerizing (i') raw material monomers for the polycondensation resin component comprising an alcohol component comprising an alkylene oxide adduct of bisphenol A represented by the formula (I):

(I)

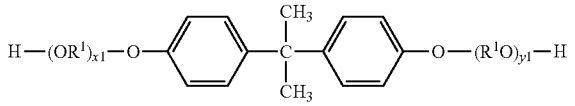

wherein $R^1O$ and $OR^1$ are an oxyalkylene group, wherein $R^1$ is an ethylene group and/or a propylene group; and each of x1 and y1 is a positive number which is an average number of moles of an alkylene oxide added, wherein a value of the sum of x1 and y1 is 1 or more and 16 or less; and a carboxylic acid component comprising an aromatic dicarboxylic acid compound;

(ii') raw material monomers for the styrenic resin component; and (iii') a dually reactive monomer capable of reacting with the raw material monomers for the polycondensation resin component and the raw material monomers for the styrenic resin component.

9. The toner for electrophotography according to claim 1, wherein a softening point of the amorphous polyester AP is 120° C. or higher and 170° C. or lower.

10. The toner for electrophotography according to claim 1, wherein the alcohol component for the amorphous polyester AP comprises an alkylene oxide adduct of bisphenol A represented by the formula (II):

(II)

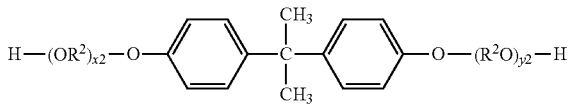

wherein $R^2O$ and $OR^2$ are an oxyalkylene group, wherein $R^2$ is an ethylene group and/or a propylene group; and each of x2 and y2 is a positive number which is an average number of moles of an alkylene oxide added, wherein a value of the sum of x2 and y2 is 1 or more and 16 or less.

11. The toner for electrophotography according to claim 1, wherein a melting point of the releasing agent is 60° C. or higher and 120° C. or lower.

12. The toner for electrophotography according to claim 1, wherein the content of the releasing agent is 0.5 parts by mass or more and 10 parts by mass or less, based on 100 parts by mass of the resin binder.

13. The toner for electrophotography according to claim 1, wherein the releasing agent is one or more members selected from the group consisting of polypropylene wax, polyethylene wax, polypropylene-polyethylene copolymer wax, microcrystalline wax, paraffin waxes, Fischer-Tropsch wax, sazole wax, ester waxes, fatty acid amides, fatty acids, higher alcohols, and metal salts of fatty acids.

14. The toner for electrophotography according to claim 1, wherein the softening point of the crystalline composite resin C is 70° C. or higher and 105° C. or lower.

15. The toner for electrophotography according to claim 1, wherein the content of the aromatic dicarboxylic acid compound contained in the carboxylic acid component for the amorphous composite resin AC is 50% by mol or more of the carboxylic acid component of the amorphous composite resin AC.

16. The toner for electrophotography according to claim 1, wherein the styrenic resin component of amorphous composite resin AC is a polymerization product of raw material monomers comprising an alkyl (meth)acrylate.

17. The toner for electrophotography according to claim 1, wherein the softening point of the amorphous composite resin AC is higher than the softening point of the crystalline composite resin C, and wherein the difference in softening points between the amorphous composite resin AC and the crystalline composite resin C is 10° C. or more and 40° C. or less.

18. The toner for electrophotography according to claim 1, wherein the content of the aromatic dicarboxylic acid compound in the carboxylic acid component for the amorphous polyester AP is 10% by mol or more and 90% by mol or less of the carboxylic acid component for the amorphous polyester AP.

19. The toner for electrophotography according to claim 1, wherein the softening point of the amorphous polyester AP is higher than the softening point of the amorphous composite resin AC, and wherein the difference in softening points between the amorphous polyester AP and the amorphous composite resin AC is 20° C. or more and 40° C. or less.

20. The toner for electrophotography according to claim 1, wherein the releasing agent comprises an ester wax and an aliphatic hydrocarbon wax.

* * * * *